US010304293B2

(12) United States Patent
Moore et al.

(10) Patent No.: US 10,304,293 B2
(45) Date of Patent: May 28, 2019

(54) SYSTEMS AND METHODS FOR MODIFYING A GRAPHICAL USER INTERFACE FOR AN ELECTRONIC GAME OF BACCARAT

(71) Applicant: Walker Digital Table Systems, LLC, Las Vegas, NV (US)

(72) Inventors: Stephen Moore, Las Vegas, NV (US); Michael Russell, Las Vegas, NV (US); John Daley, Las Vegas, NV (US)

(73) Assignee: Walker Digital Table Systems, LLC, Las Vegas, NV (US)

( * ) Notice: Subject to any disclaimer, the term of this patent is extended or adjusted under 35 U.S.C. 154(b) by 315 days.

(21) Appl. No.: 15/120,138

(22) PCT Filed: Sep. 1, 2015

(86) PCT No.: PCT/US2015/048003
§ 371 (c)(1),
(2) Date: Aug. 19, 2016

(87) PCT Pub. No.: WO2016/036775
PCT Pub. Date: Mar. 10, 2016

(65) Prior Publication Data

US 2017/0140612 A1 May 18, 2017

Related U.S. Application Data

(60) Provisional application No. 62/076,660, filed on Nov. 7, 2014, provisional application No. 62/044,661, filed on Sep. 2, 2014.

(51) Int. Cl.
*A63F 9/24* (2006.01)
*G07F 17/32* (2006.01)

(52) U.S. Cl.
CPC ..... *G07F 17/3293* (2013.01); *G07F 17/3204* (2013.01); *G07F 17/326* (2013.01);
(Continued)

(58) Field of Classification Search
USPC ..... 463/16–25
See application file for complete search history.

(56) References Cited

U.S. PATENT DOCUMENTS 8,651,932 B1 * 2/2014 Pertgen ..... G07F 17/326 273/292
8,657,662 B2 * 2/2014 Acres ..... G07F 17/32 463/20

(Continued)

OTHER PUBLICATIONS

Written Opinion for PCT/US2015/048003 dated Dec. 3, 2015; 7 pps.

(Continued)

*Primary Examiner* — Masud Ahmed
(74) *Attorney, Agent, or Firm* — Fincham Downs, LLC; Magdalena M. Fincham, Esq.

(57) ABSTRACT

In accordance with some embodiments, a gaming apparatus provides for an electronic baccarat game in which game elements are placed in a game element matrix within which a plurality of paylines are defined. Each payline consists of a baccarat hand which includes a first subset of game element positions attributed to the Player side and a second subset of game element positions attributed to the Banker side. In one embodiment, a player may place a wager on a game instance of the baccarat game and select one of a Player side and a Banker side for the wager. A payout is determined for the game instance based on which of the Player side and the Banker side the player selected and how many of the paylines resulted in a Player side win and how many of the paylines resulted in a Banker side win.

27 Claims, 41 Drawing Sheets

(52) U.S. Cl.
CPC ..... *G07F 17/3211* (2013.01); *G07F 17/3225* (2013.01); *G07F 17/3244* (2013.01)

(56) References Cited

U.S. PATENT DOCUMENTS

| | | | | |
|---|---|---|---|---|
| 8,684,811 | B2 * | 4/2014 | Acres | G07F 17/32 463/16 |
| 8,696,436 | B2 * | 4/2014 | Acres | G07F 17/3227 463/20 |
| 8,702,490 | B2 * | 4/2014 | Acres | G07F 17/32 463/19 |
| 9,345,973 | B1 * | 5/2016 | Antkowiak | G07F 17/3209 |
| 2003/0013510 | A1 * | 1/2003 | Vuong | G07F 17/32 463/13 |
| 2009/0209321 | A1 * | 8/2009 | Alderucci | G07F 17/32 463/22 |
| 2009/0286585 | A1 * | 11/2009 | Walker | G07F 17/32 463/17 |
| 2011/0183753 | A1 * | 7/2011 | Acres | G07F 17/32 463/31 |
| 2013/0001876 | A1 * | 1/2013 | Chen | G07F 17/32 273/292 |

OTHER PUBLICATIONS

International Search Report for PCT/US2015/048003 dated Dec. 3, 2015; 2 pps.
First Examination Report for Australian Application No. 2015312056 dated Mar. 9, 2017; 3 pps.
Written Opinion for Singapore Application No. 11201607003R dated Mar. 20, 2017; 5 pps.
International Preliminary Report on Patentability for PCT/US2015/048003 dated Mar. 7, 2017; 4 pps.
Examination Report No. 1 for Australian Application 2015312056 dated Mar. 9, 2017; 3 pps.
Written Opinion for Singapore Application 11201607003R dated Nov. 20, 2018; 6 pps.
Written Opinion for Singapore Application 11201607003R dated Nov. 21, 2017; 5 pps.
Office Action for Chinese Application 201580023971.0 dated Nov. 30, 2016; 2 pps.
Office Action for Chinese Application 201580023971.0 dated Oct. 17, 2018; 6 pps.
Office Action for Canadian Application 2940663 dated Aug. 9, 2017; 5 pps.
Office Action for Canadian Application 2940663 dated Aug. 14, 2018; 6 pps.

* cited by examiner

LINE 1

| BANKER | | | PLAYER | | |
|---|---|---|---|---|---|
| X | X | X | X | X | X |
| | | | | | |
| | | | | | |

LINE 2

| BANKER | | | PLAYER | | |
|---|---|---|---|---|---|
| X | X | X | X | X | |
| | | | | | X |
| | | | | | |

LINE 3

| BANKER | | | PLAYER | | |
|---|---|---|---|---|---|
| X | X | X | X | | X |
| | | | | X | |
| | | | | | |

LINE 4

| BANKER | | | PLAYER | | |
|---|---|---|---|---|---|
| X | X | X | X | | |
| | | | | X | X |
| | | | | | |

LINE 5

| BANKER | | | PLAYER | | |
|---|---|---|---|---|---|
| X | X | X | X | | |
| | | | | X | |
| | | | | | X |

LINE 6

| BANKER | | | PLAYER | | |
|---|---|---|---|---|---|
| X | X | X | | X | X |
| | | | X | | |
| | | | | | |

LINE 7

| BANKER | | | PLAYER | | |
|---|---|---|---|---|---|
| X | X | X | | X | |
| | | | X | | X |
| | | | | | |

LINE 8

| BANKER | | | PLAYER | | |
|---|---|---|---|---|---|
| X | X | X | | | X |
| | | | X | X | |
| | | | | | |

FIG. 3A

LINE 9

| BANKER | | | PLAYER | | |
|---|---|---|---|---|---|
| X | X | X | | | |
| | | | X | X | X |
| | | | | | |

LINE 10

| BANKER | | | PLAYER | | |
|---|---|---|---|---|---|
| X | X | X | | | |
| | | | X | X | |
| | | | | | X |

LINE 11

| BANKER | | | PLAYER | | |
|---|---|---|---|---|---|
| X | X | X | | | |
| | | | X | | X |
| | | | | X | |

LINE 12

| BANKER | | | PLAYER | | |
|---|---|---|---|---|---|
| X | X | X | | | |
| | | | X | | |
| | | | | X | X |

LINE 13

| BANKER | | | PLAYER | | |
|---|---|---|---|---|---|
| X | X | | | | X |
| | | X | | X | |
| | | | X | | |

LINE 14

| BANKER | | | PLAYER | | |
|---|---|---|---|---|---|
| X | X | | | | |
| | | X | | X | X |
| | | | X | | |

LINE 15

| BANKER | | | PLAYER | | |
|---|---|---|---|---|---|
| X | X | | | | |
| | | X | | X | |
| | | | X | | X |

LINE 16

| BANKER | | | PLAYER | | |
|---|---|---|---|---|---|
| X | X | | | | |
| | | X | | | X |
| | | | X | X | |

FIG. 3B

LINE 17

| BANKER | | | PLAYER | | |
|---|---|---|---|---|---|
| X | X | | | | |
| | | X | | | |
| | | | X | X | X |

LINE 18

| BANKER | | | PLAYER | | |
|---|---|---|---|---|---|
| X | X | | X | X | X |
| | | X | | | |
| | | | | | |

LINE 19

| BANKER | | | PLAYER | | |
|---|---|---|---|---|---|
| X | X | | X | X | |
| | | X | | | X |
| | | | | | |

LINE 20

| BANKER | | | PLAYER | | |
|---|---|---|---|---|---|
| X | X | | X | | X |
| | | X | | X | |
| | | | | | |

LINE 21

| BANKER | | | PLAYER | | |
|---|---|---|---|---|---|
| X | X | | X | | |
| | | X | | X | X |
| | | | | | |

LINE 22

| BANKER | | | PLAYER | | |
|---|---|---|---|---|---|
| X | X | | X | | |
| | | X | | X | |
| | | | | | X |

LINE 23

| BANKER | | | PLAYER | | |
|---|---|---|---|---|---|
| X | X | | | X | X |
| | | X | X | | |
| | | | | | |

LINE 24

| BANKER | | | PLAYER | | |
|---|---|---|---|---|---|
| X | X | | | X | |
| | | X | X | | X |
| | | | | | |

FIG. 3C

LINE 25

| BANKER | | | PLAYER | | |
|---|---|---|---|---|---|
| X | X | | | | X |
| | | X | X | X | |
| | | | | | |

LINE 26

| BANKER | | | PLAYER | | |
|---|---|---|---|---|---|
| X | X | | | | |
| | | X | X | X | X |
| | | | | | |

LINE 27

| BANKER | | | PLAYER | | |
|---|---|---|---|---|---|
| X | X | | | | |
| | | X | X | X | |
| | | | | | X |

LINE 28

| BANKER | | | PLAYER | | |
|---|---|---|---|---|---|
| X | X | | | | |
| | | X | X | | X |
| | | | | X | |

LINE 29

| BANKER | | | PLAYER | | |
|---|---|---|---|---|---|
| X | X | | | | |
| | | X | X | | |
| | | | | X | X |

LINE 30

| BANKER | | | PLAYER | | |
|---|---|---|---|---|---|
| X | | X | X | X | X |
| | X | | | | |
| | | | | | |

LINE 31

| BANKER | | | PLAYER | | |
|---|---|---|---|---|---|
| X | | X | X | X | |
| | X | | | | X |
| | | | | | |

LINE 32

| BANKER | | | PLAYER | | |
|---|---|---|---|---|---|
| X | | X | X | | X |
| | X | | | X | |
| | | | | | |

FIG. 3D

LINE 33

| BANKER | | | PLAYER | | |
|---|---|---|---|---|---|
| X | | X | X | | |
| | X | | | X | X |
| | | | | | |

LINE 34

| BANKER | | | PLAYER | | |
|---|---|---|---|---|---|
| X | | X | X | | |
| | X | | | X | |
| | | | | | X |

LINE 35

| BANKER | | | PLAYER | | |
|---|---|---|---|---|---|
| X | | X | | X | X |
| | X | | X | | |
| | | | | | |

LINE 36

| BANKER | | | PLAYER | | |
|---|---|---|---|---|---|
| X | | X | | X | |
| | X | | X | | X |
| | | | | | |

LINE 37

| BANKER | | | PLAYER | | |
|---|---|---|---|---|---|
| X | | X | | | X |
| | X | | X | X | |
| | | | | | |

LINE 38

| BANKER | | | PLAYER | | |
|---|---|---|---|---|---|
| X | | X | | | |
| | X | | X | X | X |
| | | | | | |

LINE 39

| BANKER | | | PLAYER | | |
|---|---|---|---|---|---|
| X | | X | | | |
| | X | | X | X | |
| | | | | | X |

LINE 40

| BANKER | | | PLAYER | | |
|---|---|---|---|---|---|
| X | | X | | | |
| | X | | X | | X |
| | | | | X | |

FIG. 3E

LINE 41

| BANKER | | | PLAYER | | |
|---|---|---|---|---|---|
| X | | X | | | |
| | X | | X | | |
| | | | | X | X |

LINE 42

| BANKER | | | PLAYER | | |
|---|---|---|---|---|---|
| X | | | | | X |
| | X | X | | X | |
| | | | X | | |

LINE 43

| BANKER | | | PLAYER | | |
|---|---|---|---|---|---|
| X | | | | | |
| | X | X | | X | X |
| | | | X | | |

LINE 44

| BANKER | | | PLAYER | | |
|---|---|---|---|---|---|
| X | | | | | |
| | X | X | | X | |
| | | | X | | X |

LINE 45

| BANKER | | | PLAYER | | |
|---|---|---|---|---|---|
| X | | | | | |
| | X | X | | | X |
| | | | X | X | |

LINE 46

| BANKER | | | PLAYER | | |
|---|---|---|---|---|---|
| X | | | | | |
| | X | X | | | |
| | | | X | X | X |

LINE 47

| BANKER | | | PLAYER | | |
|---|---|---|---|---|---|
| X | | | X | X | X |
| | X | X | | | |
| | | | | | |

LINE 48

| BANKER | | | PLAYER | | |
|---|---|---|---|---|---|
| X | | | X | X | |
| | X | X | | | X |
| | | | | | |

FIG. 3F

LINE 49

| BANKER | | | PLAYER | | |
|---|---|---|---|---|---|
| X | | | X | | X |
| | X | X | | X | |
| | | | | | |

LINE 50

| BANKER | | | PLAYER | | |
|---|---|---|---|---|---|
| X | | | X | | |
| | X | X | | X | X |
| | | | | | |

LINE 51

| BANKER | | | PLAYER | | |
|---|---|---|---|---|---|
| X | | | X | | |
| | X | X | | X | |
| | | | | | X |

LINE 52

| BANKER | | | PLAYER | | |
|---|---|---|---|---|---|
| X | | | | X | X |
| | X | X | X | | |
| | | | | | |

LINE 53

| BANKER | | | PLAYER | | |
|---|---|---|---|---|---|
| X | | | | X | |
| | X | X | X | | X |
| | | | | | |

LINE 54

| BANKER | | | PLAYER | | |
|---|---|---|---|---|---|
| X | | | | | X |
| | X | X | X | X | |
| | | | | | |

LINE 55

| BANKER | | | PLAYER | | |
|---|---|---|---|---|---|
| X | | | | | |
| | X | X | X | X | X |
| | | | | | |

LINE 56

| BANKER | | | PLAYER | | |
|---|---|---|---|---|---|
| X | | | | | |
| | X | X | X | X | |
| | | | | | X |

FIG. 3G

LINE 57

| BANKER | | | PLAYER | | |
|---|---|---|---|---|---|
| X | | | | | |
| | X | X | X | | X |
| | | | | X | |

LINE 58

| BANKER | | | PLAYER | | |
|---|---|---|---|---|---|
| X | | | | | |
| | X | X | X | | |
| | | | | X | X |

LINE 59

| BANKER | | | PLAYER | | |
|---|---|---|---|---|---|
| X | | | | X | X |
| | X | | X | | |
| | | X | | | |

LINE 60

| BANKER | | | PLAYER | | |
|---|---|---|---|---|---|
| X | | | | X | |
| | X | | X | | X |
| | | X | | | |

LINE 61

| BANKER | | | PLAYER | | |
|---|---|---|---|---|---|
| X | | | | | X |
| | X | | X | X | |
| | | X | | | |

LINE 62

| BANKER | | | PLAYER | | |
|---|---|---|---|---|---|
| X | | | | | |
| | X | | X | X | X |
| | | X | | | |

LINE 63

| BANKER | | | PLAYER | | |
|---|---|---|---|---|---|
| X | | | | | |
| | X | | X | X | |
| | | X | | | X |

LINE 64

| BANKER | | | PLAYER | | |
|---|---|---|---|---|---|
| X | | | | | |
| | X | | X | | X |
| | | X | | X | |

FIG. 3H

LINE 65

| BANKER | | | PLAYER | | |
|---|---|---|---|---|---|
| X | | | | | |
| | X | | X | | |
| | | X | | X | X |

LINE 66

| BANKER | | | PLAYER | | |
|---|---|---|---|---|---|
| X | | | | | X |
| | X | | | X | |
| | | X | X | | |

LINE 67

| BANKER | | | PLAYER | | |
|---|---|---|---|---|---|
| X | | | | | |
| | X | | | X | X |
| | | X | X | | |

LINE 68

| BANKER | | | PLAYER | | |
|---|---|---|---|---|---|
| X | | | | | |
| | X | | | X | |
| | | X | X | | X |

LINE 69

| BANKER | | | PLAYER | | |
|---|---|---|---|---|---|
| X | | | | | |
| | X | | | | X |
| | | X | X | X | |

LINE 70

| BANKER | | | PLAYER | | |
|---|---|---|---|---|---|
| X | | | | | |
| | X | | | | |
| | | X | X | X | X |

LINE 71

| BANKER | | | PLAYER | | |
|---|---|---|---|---|---|
| | X | X | X | X | X |
| X | | | | | |
| | | | | | |

LINE 72

| BANKER | | | PLAYER | | |
|---|---|---|---|---|---|
| | X | X | X | X | |
| X | | | | | X |
| | | | | | |

FIG. 3I

LINE 73

| BANKER | | | PLAYER | | |
|---|---|---|---|---|---|
| | X | X | X | | X |
| X | | | | X | |
| | | | | | |

LINE 74

| BANKER | | | PLAYER | | |
|---|---|---|---|---|---|
| | X | X | X | | |
| X | | | | X | X |
| | | | | | |

LINE 75

| BANKER | | | PLAYER | | |
|---|---|---|---|---|---|
| | X | X | X | | |
| X | | | | X | |
| | | | | | X |

LINE 76

| BANKER | | | PLAYER | | |
|---|---|---|---|---|---|
| | X | X | | X | X |
| X | | | X | | |
| | | | | | |

LINE 77

| BANKER | | | PLAYER | | |
|---|---|---|---|---|---|
| | X | X | | X | |
| X | | | X | | X |
| | | | | | |

LINE 78

| BANKER | | | PLAYER | | |
|---|---|---|---|---|---|
| | X | X | | | X |
| X | | | X | X | |
| | | | | | |

LINE 79

| BANKER | | | PLAYER | | |
|---|---|---|---|---|---|
| | X | X | | | |
| X | | | X | X | X |
| | | | | | |

LINE 80

| BANKER | | | PLAYER | | |
|---|---|---|---|---|---|
| | X | X | | | |
| X | | | X | X | |
| | | | | | X |

FIG. 3J

LINE 81

| BANKER | | | PLAYER | | |
|---|---|---|---|---|---|
| | X | X | | | |
| X | | | X | | X |
| | | | | X | |

LINE 82

| BANKER | | | PLAYER | | |
|---|---|---|---|---|---|
| | X | X | | | |
| X | | | X | | |
| | | | | X | X |

LINE 83

| BANKER | | | PLAYER | | |
|---|---|---|---|---|---|
| | X | | | | X |
| X | | X | | X | |
| | | | X | | |

LINE 84

| BANKER | | | PLAYER | | |
|---|---|---|---|---|---|
| | X | | | | |
| X | | X | | X | X |
| | | | X | | |

LINE 85

| BANKER | | | PLAYER | | |
|---|---|---|---|---|---|
| | X | | | | |
| X | | X | | X | |
| | | | X | | X |

LINE 86

| BANKER | | | PLAYER | | |
|---|---|---|---|---|---|
| | X | | | | |
| X | | X | | | X |
| | | | X | X | |

LINE 87

| BANKER | | | PLAYER | | |
|---|---|---|---|---|---|
| | X | | | | |
| X | | X | | | |
| | | | X | X | X |

LINE 88

| BANKER | | | PLAYER | | |
|---|---|---|---|---|---|
| | X | | X | X | X |
| X | | X | | | |
| | | | | | |

FIG. 3K

LINE 89

| BANKER | | | PLAYER | | |
|---|---|---|---|---|---|
| | X | | X | X | |
| X | | X | | | X |
| | | | | | |

LINE 90

| BANKER | | | PLAYER | | |
|---|---|---|---|---|---|
| | X | | X | | X |
| X | | X | | X | |
| | | | | | |

LINE 91

| BANKER | | | PLAYER | | |
|---|---|---|---|---|---|
| | X | | X | | |
| X | | X | | X | X |
| | | | | | |

LINE 92

| BANKER | | | PLAYER | | |
|---|---|---|---|---|---|
| | X | | X | | |
| X | | X | | X | |
| | | | | | X |

LINE 93

| BANKER | | | PLAYER | | |
|---|---|---|---|---|---|
| | X | | | X | X |
| X | | X | X | | |
| | | | | | |

LINE 94

| BANKER | | | PLAYER | | |
|---|---|---|---|---|---|
| | X | | | X | |
| X | | X | X | | X |
| | | | | | |

LINE 95

| BANKER | | | PLAYER | | |
|---|---|---|---|---|---|
| | X | | | | X |
| X | | X | X | X | |
| | | | | | |

LINE 96

| BANKER | | | PLAYER | | |
|---|---|---|---|---|---|
| | X | | | | |
| X | | X | X | X | X |
| | | | | | |

FIG. 3L

LINE 97

| BANKER | | | PLAYER | | |
|---|---|---|---|---|---|
| | X | | | | |
| X | | X | X | X | |
| | | | | | X |

LINE 98

| BANKER | | | PLAYER | | |
|---|---|---|---|---|---|
| | X | | | | |
| X | | X | X | | X |
| | | | | X | |

LINE 99

| BANKER | | | PLAYER | | |
|---|---|---|---|---|---|
| | X | | | | |
| X | | X | X | | |
| | | | | X | X |

LINE 100

| BANKER | | | PLAYER | | |
|---|---|---|---|---|---|
| | | X | X | X | X |
| X | X | | | | |
| | | | | | |

LINE 101

| BANKER | | | PLAYER | | |
|---|---|---|---|---|---|
| | | X | X | X | |
| X | X | | | | X |
| | | | | | |

LINE 102

| BANKER | | | PLAYER | | |
|---|---|---|---|---|---|
| | | X | X | | X |
| X | X | | | X | |
| | | | | | |

LINE 103

| BANKER | | | PLAYER | | |
|---|---|---|---|---|---|
| | | X | X | | |
| X | X | | | X | X |
| | | | | | |

LINE 104

| BANKER | | | PLAYER | | |
|---|---|---|---|---|---|
| | | X | X | | |
| X | X | | | X | |
| | | | | | X |

FIG. 3M

LINE 105

| BANKER | | | PLAYER | | |
|---|---|---|---|---|---|
| | | X | | X | X |
| X | X | | X | | |
| | | | | | |

LINE 106

| BANKER | | | PLAYER | | |
|---|---|---|---|---|---|
| | | X | | X | |
| X | X | | X | | X |
| | | | | | |

LINE 107

| BANKER | | | PLAYER | | |
|---|---|---|---|---|---|
| | | X | | | X |
| X | X | | X | X | |
| | | | | | |

LINE 108

| BANKER | | | PLAYER | | |
|---|---|---|---|---|---|
| | | X | | | |
| X | X | | X | X | X |
| | | | | | |

LINE 109

| BANKER | | | PLAYER | | |
|---|---|---|---|---|---|
| | | X | | | |
| X | X | | X | X | |
| | | | | | X |

LINE 110

| BANKER | | | PLAYER | | |
|---|---|---|---|---|---|
| | | X | | | |
| X | X | | X | | X |
| | | | | X | |

LINE 111

| BANKER | | | PLAYER | | |
|---|---|---|---|---|---|
| | | X | | | |
| X | X | | X | | |
| | | | | X | X |

LINE 112

| BANKER | | | PLAYER | | |
|---|---|---|---|---|---|
| | | | | | X |
| X | X | X | | X | |
| | | | X | | |

FIG. 3N

LINE 113

| BANKER | | | PLAYER | | |
|---|---|---|---|---|---|
| | | | | | |
| X | X | X | | X | X |
| | | | X | | |

LINE 114

| BANKER | | | PLAYER | | |
|---|---|---|---|---|---|
| | | | | | |
| X | X | X | | X | |
| | | | X | | X |

LINE 115

| BANKER | | | PLAYER | | |
|---|---|---|---|---|---|
| | | | | | |
| X | X | X | | | X |
| | | | X | X | |

LINE 116

| BANKER | | | PLAYER | | |
|---|---|---|---|---|---|
| | | | | | |
| X | X | X | | | |
| | | | X | X | X |

LINE 117

| BANKER | | | PLAYER | | |
|---|---|---|---|---|---|
| | | | X | X | X |
| X | X | X | | | |
| | | | | | |

LINE 118

| BANKER | | | PLAYER | | |
|---|---|---|---|---|---|
| | | | X | X | |
| X | X | X | | | X |
| | | | | | |

LINE 119

| BANKER | | | PLAYER | | |
|---|---|---|---|---|---|
| | | | X | | X |
| X | X | X | | X | |
| | | | | | |

LINE 120

| BANKER | | | PLAYER | | |
|---|---|---|---|---|---|
| | | | X | | |
| X | X | X | | X | X |
| | | | | | |

FIG. 3O

LINE 121

| BANKER | | | PLAYER | | |
|---|---|---|---|---|---|
| | | | X | | |
| X | X | X | | X | |
| | | | | | X |

LINE 122

| BANKER | | | PLAYER | | |
|---|---|---|---|---|---|
| | | | | X | X |
| X | X | X | X | | |
| | | | | | |

LINE 123

| BANKER | | | PLAYER | | |
|---|---|---|---|---|---|
| | | | | X | |
| X | X | X | X | | X |
| | | | | | |

LINE 124

| BANKER | | | PLAYER | | |
|---|---|---|---|---|---|
| | | | | | X |
| X | X | X | X | X | |
| | | | | | |

LINE 125

| BANKER | | | PLAYER | | |
|---|---|---|---|---|---|
| | | | | | |
| X | X | X | X | X | X |
| | | | | | |

LINE 126

| BANKER | | | PLAYER | | |
|---|---|---|---|---|---|
| | | | | | |
| X | X | X | X | X | |
| | | | | | X |

LINE 127

| BANKER | | | PLAYER | | |
|---|---|---|---|---|---|
| | | | | | |
| X | X | X | X | | X |
| | | | | X | |

LINE 128

| BANKER | | | PLAYER | | |
|---|---|---|---|---|---|
| | | | | | |
| X | X | X | X | | |
| | | | | X | X |

FIG. 3P

LINE 129

| BANKER | | | PLAYER | | |
|---|---|---|---|---|---|
| | | | | X | X |
| X | X | | X | | |
| | | X | | | |

LINE 130

| BANKER | | | PLAYER | | |
|---|---|---|---|---|---|
| | | | | X | |
| X | X | | X | | X |
| | | X | | | |

LINE 131

| BANKER | | | PLAYER | | |
|---|---|---|---|---|---|
| | | | | | X |
| X | X | | X | X | |
| | | X | | | |

LINE 132

| BANKER | | | PLAYER | | |
|---|---|---|---|---|---|
| | | | | | |
| X | X | | X | X | X |
| | | X | | | |

LINE 133

| BANKER | | | PLAYER | | |
|---|---|---|---|---|---|
| | | | | | |
| X | X | | X | X | |
| | | X | | | X |

LINE 134

| BANKER | | | PLAYER | | |
|---|---|---|---|---|---|
| | | | | | |
| X | X | | X | | X |
| | | X | | X | |

LINE 135

| BANKER | | | PLAYER | | |
|---|---|---|---|---|---|
| | | | | | |
| X | X | | X | | |
| | | X | | X | X |

LINE 136

| BANKER | | | PLAYER | | |
|---|---|---|---|---|---|
| | | | | | X |
| X | X | | | X | |
| | | X | X | | |

FIG. 3Q

LINE 137

| BANKER | | | PLAYER | | |
|---|---|---|---|---|---|
| | | | | | |
| X | X | | | X | X |
| | | X | X | | |

LINE 138

| BANKER | | | PLAYER | | |
|---|---|---|---|---|---|
| | | | | | |
| X | X | | | X | |
| | | X | X | | X |

LINE 139

| BANKER | | | PLAYER | | |
|---|---|---|---|---|---|
| | | | | | |
| X | X | | | | X |
| | | X | X | X | |

LINE 140

| BANKER | | | PLAYER | | |
|---|---|---|---|---|---|
| | | | | | |
| X | X | | | | |
| | | X | X | X | X |

LINE 141

| BANKER | | | PLAYER | | |
|---|---|---|---|---|---|
| | | | | | X |
| X | | X | | X | |
| | X | | X | | |

LINE 142

| BANKER | | | PLAYER | | |
|---|---|---|---|---|---|
| | | | | | |
| X | | X | | X | X |
| | X | | X | | |

LINE 143

| BANKER | | | PLAYER | | |
|---|---|---|---|---|---|
| | | | | | |
| X | | X | | X | |
| | X | | X | | X |

LINE 144

| BANKER | | | PLAYER | | |
|---|---|---|---|---|---|
| | | | | | |
| X | | X | | | X |
| | X | | X | X | |

FIG. 3R

LINE 145

| BANKER | | | PLAYER | | |
|---|---|---|---|---|---|
| | | | | | |
| X | | X | | | |
| | X | | X | X | X |

LINE 146

| BANKER | | | PLAYER | | |
|---|---|---|---|---|---|
| | | | X | X | X |
| X | | X | | | |
| | X | | | | |

LINE 147

| BANKER | | | PLAYER | | |
|---|---|---|---|---|---|
| | | | X | X | |
| X | | X | | | X |
| | X | | | | |

LINE 148

| BANKER | | | PLAYER | | |
|---|---|---|---|---|---|
| | | | X | | X |
| X | | X | | X | |
| | X | | | | |

LINE 149

| BANKER | | | PLAYER | | |
|---|---|---|---|---|---|
| | | | X | | |
| X | | X | | X | X |
| | X | | | | |

LINE 150

| BANKER | | | PLAYER | | |
|---|---|---|---|---|---|
| | | | X | | |
| X | | X | | X | |
| | X | | | | X |

LINE 151

| BANKER | | | PLAYER | | |
|---|---|---|---|---|---|
| | | | | X | X |
| X | | X | X | | |
| | X | | | | |

LINE 152

| BANKER | | | PLAYER | | |
|---|---|---|---|---|---|
| | | | | X | |
| X | | X | X | | X |
| | X | | | | |

FIG. 3S

LINE 153

| BANKER | | | PLAYER | | |
|---|---|---|---|---|---|
| | | | | | X |
| X | | X | X | X | |
| | X | | | | |

LINE 154

| BANKER | | | PLAYER | | |
|---|---|---|---|---|---|
| | | | | | |
| X | | X | X | X | X |
| | X | | | | |

LINE 155

| BANKER | | | PLAYER | | |
|---|---|---|---|---|---|
| | | | | | |
| X | | X | X | X | |
| | X | | | | X |

LINE 156

| BANKER | | | PLAYER | | |
|---|---|---|---|---|---|
| | | | | | |
| X | | X | X | | X |
| | X | | | X | |

LINE 157

| BANKER | | | PLAYER | | |
|---|---|---|---|---|---|
| | | | | | |
| X | | X | X | | |
| | X | | | X | X |

LINE 158

| BANKER | | | PLAYER | | |
|---|---|---|---|---|---|
| | | | | X | X |
| X | | | X | | |
| | X | X | | | |

LINE 159

| BANKER | | | PLAYER | | |
|---|---|---|---|---|---|
| | | | | X | |
| X | | | X | | X |
| | X | X | | | |

LINE 160

| BANKER | | | PLAYER | | |
|---|---|---|---|---|---|
| | | | | | X |
| X | | | X | X | |
| | X | X | | | |

FIG. 3T

LINE 161

| BANKER | | | PLAYER | | |
|---|---|---|---|---|---|
| | | | | | |
| X | | | X | X | X |
| | X | X | | | |

LINE 162

| BANKER | | | PLAYER | | |
|---|---|---|---|---|---|
| | | | | | |
| X | | | X | X | |
| | X | X | | | X |

LINE 163

| BANKER | | | PLAYER | | |
|---|---|---|---|---|---|
| | | | | | |
| X | | | X | | X |
| | X | X | | X | |

LINE 164

| BANKER | | | PLAYER | | |
|---|---|---|---|---|---|
| | | | | | |
| X | | | X | | |
| | X | X | | X | X |

LINE 165

| BANKER | | | PLAYER | | |
|---|---|---|---|---|---|
| | | | | | X |
| X | | | | X | |
| | X | X | X | | |

LINE 166

| BANKER | | | PLAYER | | |
|---|---|---|---|---|---|
| | | | | | |
| X | | | | X | X |
| | X | X | X | | |

LINE 167

| BANKER | | | PLAYER | | |
|---|---|---|---|---|---|
| | | | | | |
| X | | | | X | |
| | X | X | X | | X |

LINE 168

| BANKER | | | PLAYER | | |
|---|---|---|---|---|---|
| | | | | | |
| X | | | | | X |
| | X | X | X | X | |

Fig. 3U

LINE 169

| BANKER | | | PLAYER | | |
|---|---|---|---|---|---|
| | | | | | |
| X | | | | | |
| | X | X | X | X | X |

LINE 170

| BANKER | | | PLAYER | | |
|---|---|---|---|---|---|
| | | X | X | X | X |
| | X | | | | |
| X | | | | | |

LINE 171

| BANKER | | | PLAYER | | |
|---|---|---|---|---|---|
| | | X | X | X | |
| | X | | | | X |
| X | | | | | |

LINE 172

| BANKER | | | PLAYER | | |
|---|---|---|---|---|---|
| | | X | X | | X |
| | X | | | X | |
| X | | | | | |

LINE 173

| BANKER | | | PLAYER | | |
|---|---|---|---|---|---|
| | | X | X | | |
| | X | | | X | X |
| X | | | | | |

LINE 174

| BANKER | | | PLAYER | | |
|---|---|---|---|---|---|
| | | X | X | | |
| | X | | | X | |
| X | | | | | X |

LINE 175

| BANKER | | | PLAYER | | |
|---|---|---|---|---|---|
| | | X | | X | X |
| | X | | X | | |
| X | | | | | |

LINE 176

| BANKER | | | PLAYER | | |
|---|---|---|---|---|---|
| | | X | | X | |
| | X | | X | | X |
| X | | | | | |

FIG. 3V

LINE 177

| BANKER | | | PLAYER | | |
|---|---|---|---|---|---|
| | | X | | | X |
| | X | | X | X | |
| X | | | | | |

LINE 178

| BANKER | | | PLAYER | | |
|---|---|---|---|---|---|
| | | X | | | |
| | X | | X | X | X |
| X | | | | | |

LINE 179

| BANKER | | | PLAYER | | |
|---|---|---|---|---|---|
| | | X | | | |
| | X | | X | X | |
| X | | | | | X |

LINE 180

| BANKER | | | PLAYER | | |
|---|---|---|---|---|---|
| | | X | | | |
| | X | | X | | X |
| X | | | | X | |

LINE 181

| BANKER | | | PLAYER | | |
|---|---|---|---|---|---|
| | | X | | | |
| | X | | X | | |
| X | | | | X | X |

LINE 182

| BANKER | | | PLAYER | | |
|---|---|---|---|---|---|
| | | | | | X |
| | X | X | | X | |
| X | | | X | | |

LINE 183

| BANKER | | | PLAYER | | |
|---|---|---|---|---|---|
| | | | | | |
| | X | X | | X | X |
| X | | | X | | |

LINE 184

| BANKER | | | PLAYER | | |
|---|---|---|---|---|---|
| | | | | | |
| | X | X | | X | |
| X | | | X | | X |

FIG. 3W

LINE 185

| BANKER | | | PLAYER | | |
|---|---|---|---|---|---|
| | | | | | |
| | X | X | | | X |
| X | | | X | X | |

LINE 186

| BANKER | | | PLAYER | | |
|---|---|---|---|---|---|
| | | | | | |
| | X | X | | | |
| X | | | X | X | X |

LINE 187

| BANKER | | | PLAYER | | |
|---|---|---|---|---|---|
| | | | X | X | X |
| | X | X | | | |
| X | | | | | |

LINE 188

| BANKER | | | PLAYER | | |
|---|---|---|---|---|---|
| | | | X | X | |
| | X | X | | | X |
| X | | | | | |

LINE 189

| BANKER | | | PLAYER | | |
|---|---|---|---|---|---|
| | | | X | | X |
| | X | X | | X | |
| X | | | | | |

LINE 190

| BANKER | | | PLAYER | | |
|---|---|---|---|---|---|
| | | | X | | |
| | X | X | | X | X |
| X | | | | | |

LINE 191

| BANKER | | | PLAYER | | |
|---|---|---|---|---|---|
| | | | X | | |
| | X | X | | X | |
| X | | | | | X |

LINE 192

| BANKER | | | PLAYER | | |
|---|---|---|---|---|---|
| | | | | X | X |
| | X | X | X | | |
| X | | | | | |

FIG. 3X

LINE 193

| BANKER | | | PLAYER | | |
|---|---|---|---|---|---|
| | | | | X | |
| | X | X | X | | X |
| X | | | | | |

LINE 194

| BANKER | | | PLAYER | | |
|---|---|---|---|---|---|
| | | | | | X |
| | X | X | X | X | |
| X | | | | | |

LINE 195

| BANKER | | | PLAYER | | |
|---|---|---|---|---|---|
| | | | | | |
| | X | X | X | X | X |
| X | | | | | |

LINE 196

| BANKER | | | PLAYER | | |
|---|---|---|---|---|---|
| | | | | | |
| | X | X | X | X | |
| X | | | | | X |

LINE 197

| BANKER | | | PLAYER | | |
|---|---|---|---|---|---|
| | | | | | |
| | X | X | X | | X |
| X | | | | X | |

LINE 198

| BANKER | | | PLAYER | | |
|---|---|---|---|---|---|
| | | | | | |
| | X | X | X | | |
| X | | | | X | X |

LINE 199

| BANKER | | | PLAYER | | |
|---|---|---|---|---|---|
| | | | | X | X |
| | X | | X | | |
| X | | X | | | |

LINE 200

| BANKER | | | PLAYER | | |
|---|---|---|---|---|---|
| | | | | X | |
| | X | | X | | X |
| X | | X | | | |

FIG. 3Y

LINE 201

| BANKER | | | PLAYER | | |
|---|---|---|---|---|---|
| | | | | | X |
| | X | | X | X | |
| X | | X | | | |

LINE 202

| BANKER | | | PLAYER | | |
|---|---|---|---|---|---|
| | | | | | |
| | X | | X | X | X |
| X | | X | | | |

LINE 203

| BANKER | | | PLAYER | | |
|---|---|---|---|---|---|
| | | | | | |
| | X | | X | X | |
| X | | X | | | X |

LINE 204

| BANKER | | | PLAYER | | |
|---|---|---|---|---|---|
| | | | | | |
| | X | | X | | X |
| X | | X | | X | |

LINE 205

| BANKER | | | PLAYER | | |
|---|---|---|---|---|---|
| | | | | | |
| | X | | X | | |
| X | | X | | X | X |

LINE 206

| BANKER | | | PLAYER | | |
|---|---|---|---|---|---|
| | | | | | X |
| | X | | | X | |
| X | | X | X | | |

LINE 207

| BANKER | | | PLAYER | | |
|---|---|---|---|---|---|
| | | | | | |
| | X | | | X | X |
| X | | X | X | | |

LINE 208

| BANKER | | | PLAYER | | |
|---|---|---|---|---|---|
| | | | | | |
| | X | | | X | |
| X | | X | X | | X |

FIG. 3Z

LINE 209

| BANKER | | | PLAYER | | |
|---|---|---|---|---|---|
| | | | | | |
| | X | | | | X |
| X | | X | X | X | |

LINE 210

| BANKER | | | PLAYER | | |
|---|---|---|---|---|---|
| | | | | | |
| | X | | | | |
| X | | X | X | X | X |

LINE 211

| BANKER | | | PLAYER | | |
|---|---|---|---|---|---|
| | | | | | X |
| | | X | | X | |
| X | X | | X | | |

LINE 212

| BANKER | | | PLAYER | | |
|---|---|---|---|---|---|
| | | | | | |
| | | X | | X | X |
| X | X | | X | | |

LINE 213

| BANKER | | | PLAYER | | |
|---|---|---|---|---|---|
| | | | | | |
| | | X | | X | |
| X | X | | X | | X |

LINE 214

| BANKER | | | PLAYER | | |
|---|---|---|---|---|---|
| | | | | | |
| | | X | | | X |
| X | X | | X | X | |

LINE 215

| BANKER | | | PLAYER | | |
|---|---|---|---|---|---|
| | | | | | |
| | | X | | | |
| X | X | | X | X | X |

LINE 216

| BANKER | | | PLAYER | | |
|---|---|---|---|---|---|
| | | | X | X | X |
| | | X | | | |
| X | X | | | | |

FIG. 3AA

LINE 217

| BANKER | | | PLAYER | | |
|---|---|---|---|---|---|
| | | | X | X | |
| | | X | | | X |
| X | X | | | | |

LINE 218

| BANKER | | | PLAYER | | |
|---|---|---|---|---|---|
| | | | X | | X |
| | | X | | X | |
| X | X | | | | |

LINE 219

| BANKER | | | PLAYER | | |
|---|---|---|---|---|---|
| | | | X | | |
| | | X | | X | X |
| X | X | | | | |

LINE 220

| BANKER | | | PLAYER | | |
|---|---|---|---|---|---|
| | | | X | | |
| | | X | | X | |
| X | X | | | | X |

LINE 221

| BANKER | | | PLAYER | | |
|---|---|---|---|---|---|
| | | | | X | X |
| | | X | X | | |
| X | X | | | | |

LINE 222

| BANKER | | | PLAYER | | |
|---|---|---|---|---|---|
| | | | | X | |
| | | X | X | | X |
| X | X | | | | |

LINE 223

| BANKER | | | PLAYER | | |
|---|---|---|---|---|---|
| | | | | | X |
| | | X | X | X | |
| X | X | | | | |

LINE 224

| BANKER | | | PLAYER | | |
|---|---|---|---|---|---|
| | | | | | |
| | | X | X | X | X |
| X | X | | | | |

FIG. 3BB

LINE 225

| BANKER | | | PLAYER | | |
|---|---|---|---|---|---|
| | | | | | |
| | | X | X | X | |
| X | X | | | | X |

LINE 226

| BANKER | | | PLAYER | | |
|---|---|---|---|---|---|
| | | | | | |
| | | X | X | | X |
| X | X | | | X | |

LINE 227

| BANKER | | | PLAYER | | |
|---|---|---|---|---|---|
| | | | | | |
| | | X | X | | |
| X | X | | | X | X |

LINE 228

| BANKER | | | PLAYER | | |
|---|---|---|---|---|---|
| | | | | X | X |
| | | | X | | |
| X | X | X | | | |

LINE 229

| BANKER | | | PLAYER | | |
|---|---|---|---|---|---|
| | | | | X | |
| | | | X | | X |
| X | X | X | | | |

LINE 230

| BANKER | | | PLAYER | | |
|---|---|---|---|---|---|
| | | | | | X |
| | | | X | X | |
| X | X | X | | | |

LINE 231

| BANKER | | | PLAYER | | |
|---|---|---|---|---|---|
| | | | | | |
| | | | X | X | X |
| X | X | X | | | |

LINE 232

| BANKER | | | PLAYER | | |
|---|---|---|---|---|---|
| | | | | | |
| | | | X | X | |
| X | X | X | | | X |

FIG. 3CC

LINE 233

| BANKER | | | PLAYER | | |
|---|---|---|---|---|---|
| | | | | | |
| | | | X | | X |
| X | X | X | | X | |

LINE 234

| BANKER | | | PLAYER | | |
|---|---|---|---|---|---|
| | | | | | |
| | | | X | | |
| X | X | X | | X | X |

LINE 235

| BANKER | | | PLAYER | | |
|---|---|---|---|---|---|
| | | | | | X |
| | | | | X | |
| X | X | X | X | | |

LINE 236

| BANKER | | | PLAYER | | |
|---|---|---|---|---|---|
| | | | | | |
| | | | | X | X |
| X | X | X | X | | |

LINE 237

| BANKER | | | PLAYER | | |
|---|---|---|---|---|---|
| | | | | | |
| | | | | X | |
| X | X | X | X | | X |

LINE 238

| BANKER | | | PLAYER | | |
|---|---|---|---|---|---|
| | | | | | |
| | | | | | X |
| X | X | X | X | X | |

Line 239

| BANKER | | | PLAYER | | |
|---|---|---|---|---|---|
| | | | | | |
| | | | | | |
| X | X | X | X | X | X |

Line 240

| BANKER | | | PLAYER | | |
|---|---|---|---|---|---|
| X | X | | | | X |
| | | X | X | | |
| | | | | X | |

FIG. 3DD

Line 241

| BANKER | | | PLAYER | | |
|---|---|---|---|---|---|
| X | X | | | X | X |
| | | | | | |
| | | X | X | | |

Line 242

| BANKER | | | PLAYER | | |
|---|---|---|---|---|---|
| X | X | | | | X |
| | | | | X | |
| | | X | X | | |

Line 243

| BANKER | | | PLAYER | | |
|---|---|---|---|---|---|
| X | X | | | | X |
| | | | | | |
| | | X | X | X | |

Line 244

| BANKER | | | PLAYER | | |
|---|---|---|---|---|---|
| X | | X | X | | X |
| | X | | | | |
| | | | | X | |

Line 245

| BANKER | | | PLAYER | | |
|---|---|---|---|---|---|
| X | | | | | X |
| | X | X | X | | |
| | | | | X | |

Line 246

| BANKER | | | PLAYER | | |
|---|---|---|---|---|---|
| X | | | | X | X |
| | X | | | | |
| | | X | X | | |

Line 247

| BANKER | | | PLAYER | | |
|---|---|---|---|---|---|
| X | | | | | X |
| | X | | | | |
| | | X | X | X | |

Line 248

| BANKER | | | PLAYER | | |
|---|---|---|---|---|---|
| X | | X | X | X | X |
| | | | | | |
| | X | | | | |

FIG. 3EE

Line 249

| BANKER | | | PLAYER | | |
|---|---|---|---|---|---|
| X | | X | X | | X |
| | | | | X | |
| | X | | | | |

Line 250

| BANKER | | | PLAYER | | |
|---|---|---|---|---|---|
| X | | X | X | | X |
| | | | | | |
| | X | | | X | |

Line 251

| BANKER | | | PLAYER | | |
|---|---|---|---|---|---|
| X | | | | X | X |
| | | X | X | | |
| | X | | | | |

Line 252

| BANKER | | | PLAYER | | |
|---|---|---|---|---|---|
| X | | | | | X |
| | | X | X | X | |
| | X | | | | |

Line 253

| BANKER | | | PLAYER | | |
|---|---|---|---|---|---|
| X | | | | | X |
| | | X | X | | |
| | X | | | X | |

Line 254

| BANKER | | | PLAYER | | |
|---|---|---|---|---|---|
| X | | | | X | X |
| | | | | | |
| | X | X | X | | |

Line 255

| BANKER | | | PLAYER | | |
|---|---|---|---|---|---|
| X | | | | | X |
| | | | | X | |
| | X | X | X | | |

Line 256

| BANKER | | | PLAYER | | |
|---|---|---|---|---|---|
| X | | | | | X |
| | | | | | |
| | X | X | X | X | |

FIG. 3FF

Line 257

| BANKER | | | PLAYER | | |
|---|---|---|---|---|---|
| | X | X | X | | |
| X | | | | | X |
| | | | | X | |

Line 258

| BANKER | | | PLAYER | | |
|---|---|---|---|---|---|
| | X | | | X | |
| X | | | | | X |
| | | X | X | | |

Line 259

| BANKER | | | PLAYER | | |
|---|---|---|---|---|---|
| | X | | | | |
| X | | | | X | X |
| | | X | X | | |

Line 260

| BANKER | | | PLAYER | | |
|---|---|---|---|---|---|
| | X | | | | |
| X | | | | | X |
| | | X | X | X | |

Line 261

| BANKER | | | PLAYER | | |
|---|---|---|---|---|---|
| | | X | X | | |
| X | X | | | | X |
| | | | | X | |

Line 262

| BANKER | | | PLAYER | | |
|---|---|---|---|---|---|
| | | | | X | |
| X | X | | | | X |
| | | X | X | | |

Line 263

| BANKER | | | PLAYER | | |
|---|---|---|---|---|---|
| | | X | X | X | |
| X | | | | | X |
| | X | | | | |

Line 264

| BANKER | | | PLAYER | | |
|---|---|---|---|---|---|
| | | X | X | | |
| X | | | | X | X |
| | X | | | | |

FIG. 3GG

Line 265

| BANKER | | | PLAYER | | |
|---|---|---|---|---|---|
| | | X | X | | |
| X | | | | | X |
| | X | | | X | |

Line 266

| BANKER | | | PLAYER | | |
|---|---|---|---|---|---|
| | | | | X | |
| X | | | | | X |
| | X | X | X | | |

Line 267

| BANKER | | | PLAYER | | |
|---|---|---|---|---|---|
| | X | X | X | X | |
| | | | | | |
| X | | | | | X |

Line 268

| BANKER | | | PLAYER | | |
|---|---|---|---|---|---|
| | X | X | X | | |
| | | | | X | |
| X | | | | | X |

Line 269

| BANKER | | | PLAYER | | |
|---|---|---|---|---|---|
| | X | X | X | | |
| | | | | | |
| X | | | | X | X |

Line 270

| BANKER | | | PLAYER | | |
|---|---|---|---|---|---|
| | X | | | X | |
| | | X | X | | |
| X | | | | | X |

Line 271

| BANKER | | | PLAYER | | |
|---|---|---|---|---|---|
| | X | | | | |
| | | X | X | X | |
| X | | | | | X |

Line 272

| BANKER | | | PLAYER | | |
|---|---|---|---|---|---|
| | X | | | | |
| | | X | X | | |
| X | | | | X | X |

Line 3HH

Line 273

| BANKER | | | PLAYER | | |
|---|---|---|---|---|---|
| | X | | | X | |
| | | | | | |
| X | | X | X | | X |

Line 274

| BANKER | | | PLAYER | | |
|---|---|---|---|---|---|
| | X | | | | |
| | | | | X | |
| X | | X | X | | X |

Line 275

| BANKER | | | PLAYER | | |
|---|---|---|---|---|---|
| | X | | | | |
| | | | | | |
| X | | X | X | X | X |

Line 276

| BANKER | | | PLAYER | | |
|---|---|---|---|---|---|
| | | X | X | X | |
| | X | | | | |
| X | | | | | X |

Line 277

| BANKER | | | PLAYER | | |
|---|---|---|---|---|---|
| | | X | X | | |
| | X | | | | |
| X | | | | X | X |

Line 278

| BANKER | | | PLAYER | | |
|---|---|---|---|---|---|
| | | | | X | |
| | X | X | X | | |
| X | | | | | X |

Line 279

| BANKER | | | PLAYER | | |
|---|---|---|---|---|---|
| | | | | X | |
| | X | | | | |
| X | | X | X | | X |

Line 280

| BANKER | | | PLAYER | | |
|---|---|---|---|---|---|
| | | X | X | X | |
| | | | | | |
| X | X | | | | X |

FIG. 3II

Line 281

| BANKER | | | PLAYER | | |
|---|---|---|---|---|---|
| | | X | X | | |
| | | | | X | |
| X | X | | | | X |

Line 282

| BANKER | | | PLAYER | | |
|---|---|---|---|---|---|
| | | X | X | | |
| | | | | | |
| X | X | | | X | X |

Line 283

| BANKER | | | PLAYER | | |
|---|---|---|---|---|---|
| | | | | X | |
| | | X | X | | |
| X | X | | | | X |

Line 284

| BANKER | | | PLAYER | | |
|---|---|---|---|---|---|
| | | | | X | |
| | | | | | |
| X | X | X | X | | X |

Line 285

| BANKER | | | PLAYER | | |
|---|---|---|---|---|---|
| | | | X | X | X |
| | | | | | |
| X | X | X | | | |

Line 286

| BANKER | | | PLAYER | | |
|---|---|---|---|---|---|
| X | X | X | | | |
| | | | | | |
| | | | X | X | X |

Line 287

| BANKER | | | PLAYER | | |
|---|---|---|---|---|---|
| X | | X | | X | |
| | | | | | |
| | X | | X | | X |

Line 288

| BANKER | | | PLAYER | | |
|---|---|---|---|---|---|
| | X | | X | | X |
| | | | | | |
| X | | X | | X | |

FIG. 3JJ

SYSTEMS AND METHODS FOR MODIFYING A GRAPHICAL USER INTERFACE FOR AN ELECTRONIC GAME OF BACCARAT

CLAIM OF PRIORITY

The present application claims the benefit of priority of (i) U.S. Provisional Application No. 62/044,661 filed Sep. 2, 2014 in the name of Moore et al., titled SYSTEMS AND METHODS FOR BACCARAT; and (ii) U.S. Provisional Application No. 62/076,660 filed Nov. 7, 2014 in the name of Moore et al., titled SYSTEMS AND METHODS FOR BACCARAT. The entirety of each of these provisional applications is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BRIEF DESCRIPTION OF THE FIGURES

FIGS. 3A-3JJ are illustrations of example paylines which may be utilized to in one or more embodiments described herein.

DETAILED DESCRIPTION OF EXAMPLE EMBODIMENTS

I. Introduction

Figure 1:
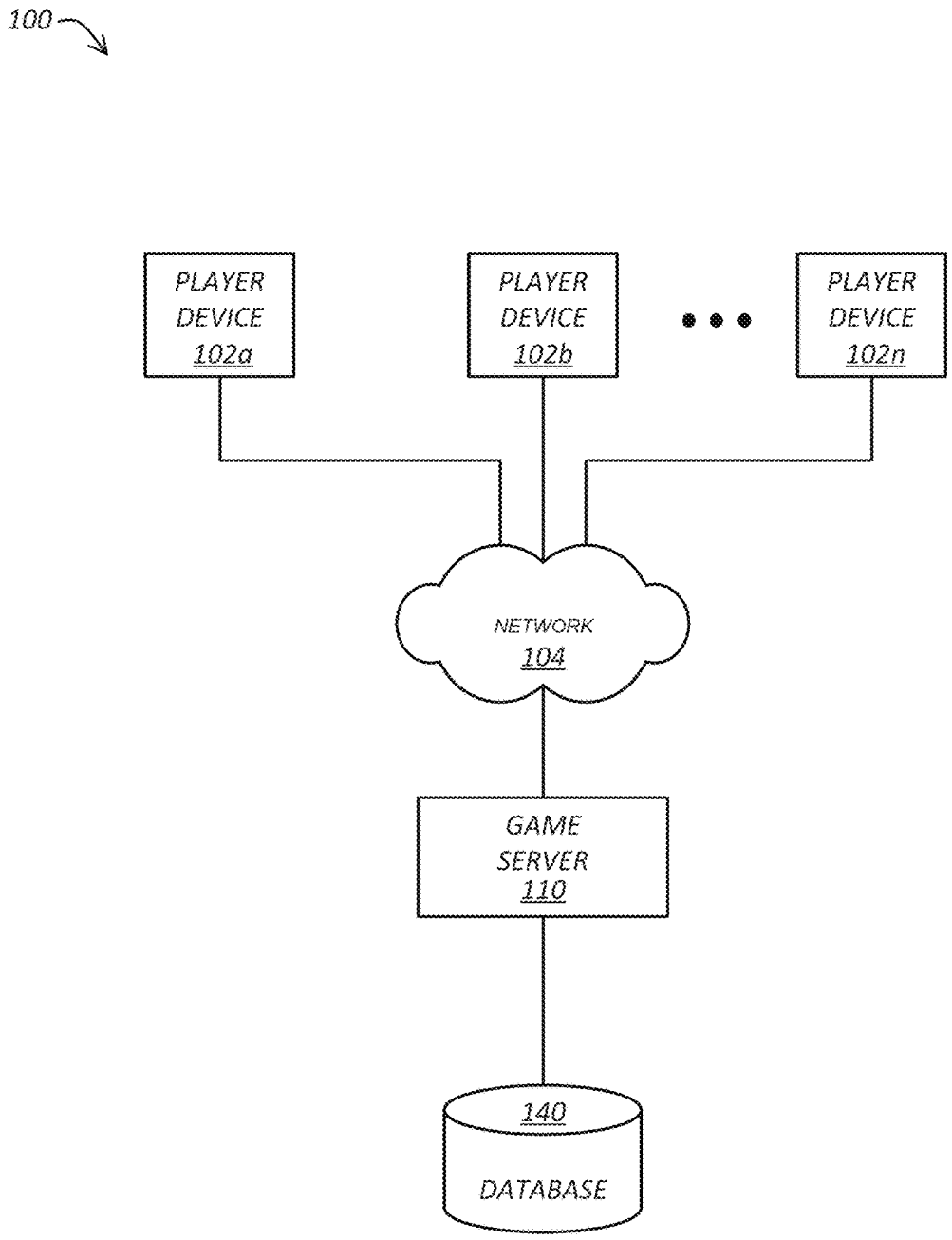
FIG. 1 is a schematic diagram of an embodiment of a gaming system in accordance with one or more embodiments described herein.

Described herein are various embodiments of an inventive electronic (e.g., online) baccarat game which provides for a new kind of betting opportunity, and systems for managing a graphical user interface (GUI) to facilitate a player's interactions with an application for facilitating the electronic baccarat game. In accordance with some embodiments, the baccarat game provides for a plurality of paylines and allows players to place a wager on either a Banker side or a Player side and receive a payout or award based on the number of Banker or Player wins among the plurality of paylines. In one embodiments, a total of 288 paylines is provided. In another embodiment, a total of 239 paylines is provided. However, any number of paylines may be implemented and the embodiments described herein are not dependent on any particular number of paylines. However, it should be noted that if more than a handful of paylines is utilized (e.g., more than three), manually determining the winning side for each payline and the appropriate payout for the game instance would be impractical within a reasonable amount of time. However, a specially programmed gaming apparatus may perform such payline evaluations and payout calculations almost instantaneously for even a significantly large number of paylines (e.g., over 50 paylines), thus allowing for an exciting game with many winning possibilities that can be resolved efficiently and allow for a smooth game flow.

In one embodiment, each payline comprises its own baccarat hand consisting of a set of element positions (e.g., six element positions per payline), with a first subset of element positions of each hand attributable to the Banker side and a second subset of element positions of each hand attributable to the Player side (e.g., three element positions attributable to the Banker side and three element positions attributable to the Banker side). In accordance with some embodiments, a player selects a side when making a wager: Banker or Player. For each hand or payline, six cards are determined (e.g., in a multiple row configuration in accordance with some embodiments, such as a three row matrix), with three of the six cards being attributable to the Player side and three being attributable to the Banker side, the six cards being placed within the element positions along each payline. In some embodiments or circumstances, less than three cards for at least one of the Banker side and the Player side may be determined and/or placed, as explained elsewhere herein. At the resolution of a given game event (when all element positions have been populated with cards or at least when all elements and positions thereof have been determined, even if they have not yet been placed or revealed to the player), the number of Banker wins and the number of Player wins are determined. In accordance with one embodiment, each payline is individually evaluated for either a Banker win, a Player win or a Tie and the player is paid based on the number of wins attributable to the side on which the player wagered on (in some embodiments the player is also rewarded to some extent for Ties, as described elsewhere herein). In one example embodiment, if a player had selected Banker side when placing the wager, the player would be paid a first amount if the number of Banker side wins for a particular game instance was a first number (e.g., a first number within a first range of numbers, in a tiered payout schedule), a second amount if the number of Banker side wins for the particular game instance was a second number (e.g., a first number within a second range of numbers), etc. In one example embodiment, a player may be provided with what is referred to as a primary payout based on the specific number of wins attributable to the side on which he selected for the wager (Banker or Player) and then a further bonus payout or other prize based on what range, tier or level that number of wins fits into (e.g., the higher the number of wins, the more valuable the prize(s) available). Such an embodiment is described in more detail herein with reference to FIG. 4.

Some other bonus wagers (examples of which are described below) may also be made available in different versions of the game. As described below, the examples of 288 possible wins or the 239 possible wins for a given side as well as the particular numbers of rows or cards in each row in a game interface are provided for illustrative purposes only and are not intended to be limiting. The embodiments described herein are not limited to any particular number of possible wins (i.e., paylines), any particular number of rows of element positions or any particular number of element positions in a given row.

In accordance with one embodiment, a game interface comprises a game symbol matrix (also referred to as a symbol matrix herein) which includes a plurality of positions, each position for displaying a respective game element or symbol of the game (e.g., a card of the baccarat game). The terms "element" and "symbol" are used interchangeably herein to refer to an image, character or other indicium of the game, used to indicate a result of the game. In accordance with one embodiment, the symbol matrix may be arranged such that there are three (3) rows, each row comprising six (6) element positions. In one embodiment, at the initiation of a new game event (e.g., dealing of a new set of hands of the baccarat game, by populating each of the symbol positions of the matrix with cards), three (3) rows of cards are dealt, each row having six (6) cards. Of course, the number of rows and the number of cards in each row may be modified and the embodiments described herein are not dependent on any particular number of rows or cards in a row.

In some hands, not all available card positions (e.g., not all six (6) card positions) of a given hand may be needed to determine a winning side for the hand. For example, in accordance with some rules for a baccarat game, initially only two (2) cards are dealt to the player side and two (2) cards are dealt to the banker side and a third card may not be dealt or needed in order to determine whether the banker side or the player side wins the hand (e.g., it may be, based on the initial four (4) cards dealt, that the player side is dealt a natural 8 or 9 and is the winning side). Or, similarly, although three (3) cards may be dealt face-down for each side, only two (2) cards of each side may be flipped over or otherwise revealed to determine a point value for each side and the third card may initially remain face-down. For example, even if three (3) cards are dealt to each of the player side and the banker side, in some circumstances only two (e.g., the first two) cards may be utilized to determine a respective value for each side and therefore a winning side for the hand. In embodiments in which the fifth or sixth card is not needed or desired to be dealt to complete a hand (or such card(s) is/are dealt but is/are not utilized to determine a winning side for the hand, and perhaps not initially revealed to the player), such a position may be utilized to effectuate a bonus or secondary feature for the game. For example, in accordance with one embodiment, any four or five card hands will be given an extra card with a value of 0 (10, J, Q, or K) to complete the six card hand. In another embodiment, the fifth or sixth card in a hand may be populated with a random value to be utilized as a multiplier for any prize or payout won as a result of that hand. Other secondary or bonus features which may be implemented for a game, whether by utilizing such a fifth or sixth card position which is not being utilized to determine a point value for a banker side or a player side, are described elsewhere herein.

Figure 4:
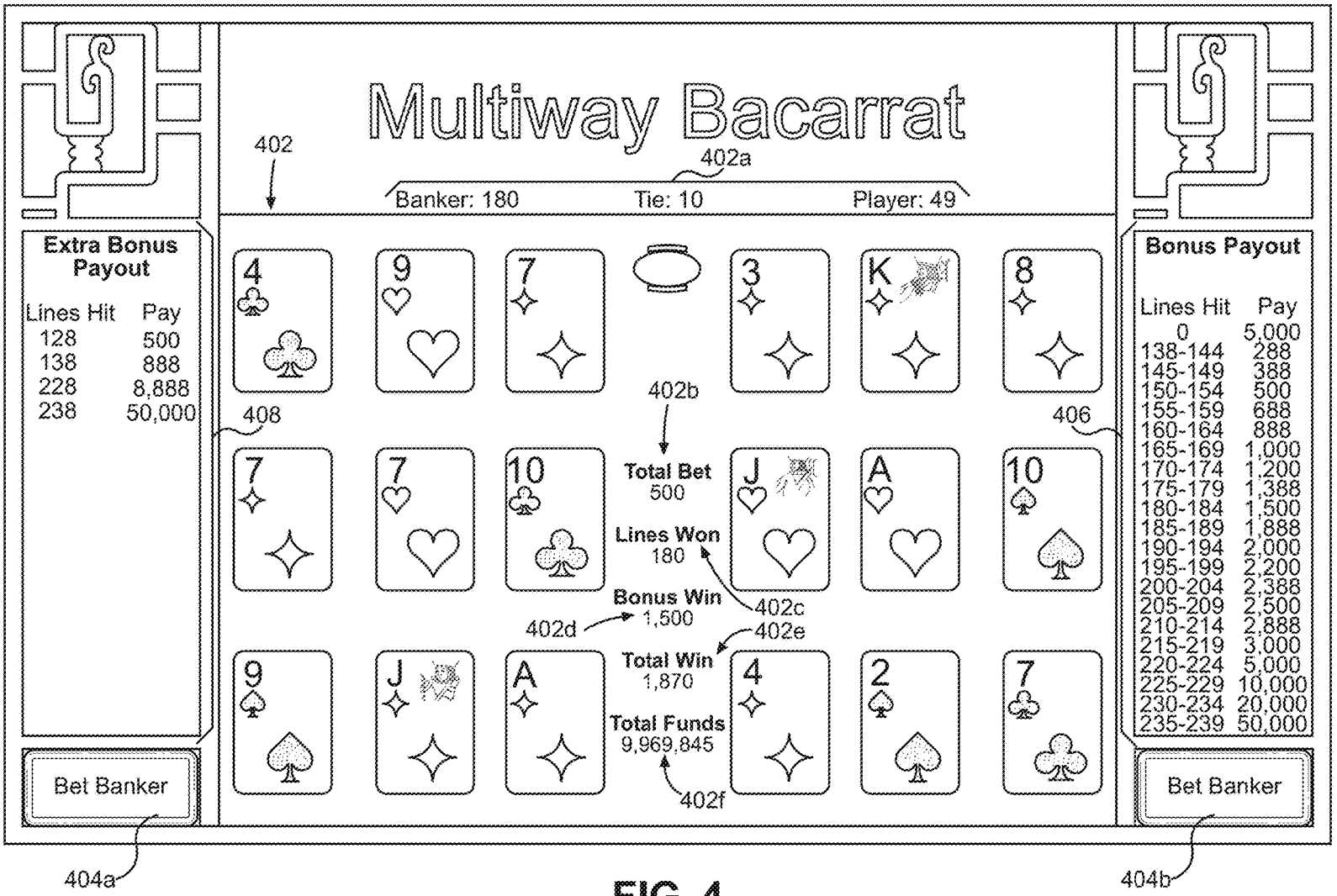
FIG. 4 is an illustration of an example Graphical User Interface for an electronic baccarat game utilizing multiple paylines, in accordance with one or more embodiments described herein.

Returning now to a description of the base game (which has a plurality of possible paylines, such as the example 288 paylines resulting from a three-by-six matrix described above) players will wager on either Banker or Player (the two different "sides" available in the game) and will be paid from a paytable based on how many of the wagered side wins there are. For example, in one embodiment if the number of wins for the side wagered on by the player is within a first range of numbers, the player's payout is based on a first category of payout, amounts or odds while if the number of wins for the side wagered on by the player is within a second range of numbers, the player's payout is based on a second category, amount or odds. FIGS. 3A-3JJ illustrate 288 possible paylines which may be utilized in one embodiment of a baccarat game and FIG. 4 illustrates two example payout schedules which may be utilized to calculate a payout for a game instance.

In accordance with some embodiments, a determination of whether, in a hand or set of cards (e.g., six cards) in a game of baccarat consistent with the embodiments described herein, the Banker side wins or the Player side wins (or whether there is a Tie) may be based on a valuation of the cards in accordance with the traditional rules of valuating a hand in baccarat. For example, each card dealt to the Banker side (i.e., the Banker hand) and each card dealt to the Player side (i.e., the Player hand) may be attributed a point value as follows: (i) cards having the numerals two (2) through nine (9) depicted thereon may have their face value in points (e.g., a card with a "2" on it is worth 2 points towards a final point value of the hand, a card with a "3" on it is worth 3 points towards a final point value of the hand, etc.); (ii) cards having 10s, Js, Qs and Ks may have a zero point value (i.e. are worth zero points); and (iii) Aces may have a 1 point value (Jokers may, in some embodiments, not be used in the game). Further, each of the Banker hand and the Player hand may be valued by summing the point value of each card comprising the respective hand according to the rightmost digit of the sum of their constituent cards: for example, a hand consisting of 2 and 3 is worth 5, but a hand consisting of 6 and 7 is worth 3 (i.e. the 3 being the rightmost digit in the combined points total: 13), such that the highest possible hand value in Baccarat is 9. The hand with the highest point value (or the point value closest to 9) may be considered the winning hand (e.g., if Banker hand has a value of 7 and Player hand has a value of 9, the Player side is determined to be the winning hand or winning side). Of course, any desired scheme for valuing hands, point system for attributing value to cards comprising a hand of other mechanism for determining a winning side or a winning hand may be implemented. The above methodology is provided as an example only and the embodiments described herein are not dependent on any particular method for determining whether the Player side or the Banker side wins a given hand or game event in a game of baccarat.

It should be noted that, in accordance with some embodiments, the payouts for Banker side wins and Player side wins may be determined in accordance with odds consistent with the odds used in traditional games of baccarat. For example, a payout for a Banker side win may be paid 1:0.95 while a payout for a Player side win may be paid 1:1 in a commission structure in which the house takes a commission. Or, in a no commission structure, the payout odds for a Banker side wins may be adjusted such that a Banker side win may be paid 1:1, except on a Banker side win of 6, in which case the payout odds would be 1:0.50. The Banker side win odds are adjusted in a no commission structure such that the odds of the game are not impacted. Thus, for example, a $100 Banker wager that wins gets paid back the original $100 and an additional $100 or $100 profit on any Banker win of 1, 2, 3, 4, 5, 7, 8, 9 while a Banker wager of $100 with a win of $100 pays back the original $100 and an additional $50 or $50 profit on a banker win of 6. Player payouts do not change. It should be understood that any payout odds may be used in a baccarat game consistent with embodiments described herein; the above odds scheme are provided for illustrative purposes only and are not to be taken in a limiting fashion.

The determination of which card to deal into each row or hand of cards may be based on one or more sources. For example, in one embodiment a random number generator (comprising software and/or hardware for selecting cards to be dealt for a hand or other game event on a random or pseudo-random basis) may be utilized to determine the cards to be dealt as an outcome of a hand, bet or other game event for a video baccarat game as described herein. In another embodiment, "live game play data" may be a source for determining the cards. Live game play data may comprise data indicating cards dealt (simultaneously or essentially simultaneously, such as within the past predetermined period of time, such as within the past thirty (30) minutes or less) on one or more physical tables (e.g., cards dealt from a physical shoe at the table or manually dealt by a dealer). The live game play data may include, for example, an indication of at least one of (i) an outcome determined for a respective one or more hands, bets or other game events; (ii) a result determined for a respective one or more hands, bets or other game events (e.g., a payout won, an indication of a winner for a hand, bet or other game event), (iii) a rank or characteristic of a hand, bet or other game event; (iv) a suit, rank or other characteristic of a card or other game indicia output for a respective one or more hands, bets or other game events; (v) the one or more cards or other game indicia output for a respective one or more hands, bet or other game events. It should be noted that there may be some overlap in the scope of the examples listed above (e.g., an indication of an outcome in a card game may comprise an indication of a card comprising the outcome).

Live table games generally include a live dealer that deals randomly-ordered physical playing cards to players seated at a physical gaming table, and involves the use of physical gaming chips for wagering by the players at the gaming table during the play of the game. A live table game may also involve an automated system for dealing physical playing cards to players seated at a physical gaming table but without a live dealer present (e.g., the physical table may provide for a remote dealer or software which simulates a dealer).

In accordance with some embodiments, live game play data may be obtained through wager detections systems, which may include at least one of hardware and software for identifying, storing, analyzing and/or transmitting events (e.g., results, outcomes, wagers, etc.) which have occurred during or in association with a live table game. For example, a wager detection system may include at least one of (i) RFID tagged gaming chips and corresponding RFID sensing devices; (ii) one or more card reading devices; (iii) a camera positioned to capture card images for detection; (iv) an optical reader incorporated in a gaming table; (v) an automated shuffling device and a playing card shoe (e.g., an electronic shoe which is operable to communicate with a processor to indicate at least one of an outcome or result of a wager and/or the game symbols comprising an outcome for a wager); (vi) Near Field Communication (NFC) protocols; and (vii) proximity card technology. Once received or otherwise determined, the live game play data may be stored, processed, analyzed, selected and/or communicated as repurposed game play data for display on one or more player devices through any appropriate wired or wireless communication hardware and software technology.

In one embodiment, a source of live game play data may comprise a table selected by a player. For example, in one embodiment a player may be requested, upon initiating a new game, to indicate whether (s)he is wagering on a Player side or a Banker side. The system may then determine, based on live game play data, a plurality of live tables with active trends on the selected side, whether Player or Banker. The live game play data may be for tables within a single gaming establishment or for tables across multiple gaming establishments. A representation or indication of the identified tables may then be presented to the player (or a subset of the identified tables, if there is a large number of tables identified as having trends on the selected side). The player may then be provided with an opportunity to select a specified number of the tables with active trends (e.g., one, two or three tables, depending on the number of hands being played in the base game) and the cards dealt in the next hands (or the outcomes of the next hands dealt) on the selected tables will comprise the cards dealt in the initial game being played by the player.

The systems, processes and articles of manufacture described herein may be operable to utilize the live game play data as repurposed game play data to provide games or wagering opportunities at one or more of player devices. The wagering opportunities or games so provided may be based on, or simulations of, the live game play data of the underlying game or original game from which the data originated. In one embodiment, the systems, methods and articles of manufacture described herein may be operable to provide additional wagering games or opportunities which differ from the underlying or original game based upon which the game data was determined.

In yet another example, a source for cards to be dealt in a virtual baccarat game may comprise "historical game play data". Historical game play data may comprise, for example, data indicating cards dealt (or any of the other data types described with respect to live game play data) which was determined at a physical table (or electronic baccarat device) more than a predetermined period of time ago (e.g., more than thirty (30) minutes ago, which has been stored in a database or other memory mechanism. A system controller, which may take any form, including one or more general purpose computers, specific purpose computers or servers, may receive, determine, store, analyze, categorize, select and/or repurpose the live game play data for one or more additional wagering opportunities on a player device (e.g., a dedicated device for outputting a virtual baccarat game or a non-dedicated device such as a smart phone or tablet computer, on which software for facilitating the baccarat game has been installed). Various examples of player devices are described herein with respect to FIG. 1.

In accordance with some embodiments, one or more bonus games or versions of the game may be provided. Below are some non-limiting examples of different variations of a baccarat game consistent with one or more embodiments described herein.

In one variation of a baccarat game consistent with embodiments described herein, for each row of symbol positions in a symbol matrix (e.g., for each of 3 rows), only a subset of the symbol positions are populated based on cards determined by the system (e.g., based on cards determined from an RNG, live game play data or historical game play data). For example, four or five cards in each row may initially be populated.

In some embodiments in which only a subset of the symbol positions for a given row are initially populated, a player may be provided with an opportunity to pick the one or two cards (which are face down when the player selects them, such that the player is not aware of the value of the cards) to fill the remaining one or more symbol positions in each row which are not filled with cards based on an initial dealing of cards for the hand. For example, the player may be allowed to select the one or two cards needed to complete four and five card hands to make them six card hands. For example, once the initial deal of the four or five cards is output to the player the player may be provided with an interface on which is output a matrix of available face down cards for the player's selection (e.g., the benefit or value of the card may be revealed to the player after the player selects the card). In some embodiments, the point value of these cards will be 0, however some of them will also have a benefit (e.g., a multiplier) associated with them. The benefit (e.g., multiplier) associated with a selected card may be applied to a result of the hand in which the card is placed or to a total result for the hand or game event. In one embodiment, the benefit may comprise a value or number to be applied (e.g., multiplied or added) to a number of wins on the side (e.g., Banker or Player) on which the player wagered. For example, a player may pick a card revealed to be associated with a 6× multiplier to be applied to the win count corresponding to the hand(s) or payline(s) in which the card is included, such that if the player had bet on the Banker side and the Banker side wins for the hand in which the card associated with the 6× multiplier is included, the player would get a count of 6 extra wins attributed to the number of Banker side wins to help increase their total payout for the hand or game event being resolved. Alternatively, a card may be revealed to operate on a win count by causing a specified number of extra wins to be added to a win count associated with the payline(s) in which it is included (e.g., the card is revealed to add 5 wins to the hand in which it is included). In another example, the benefit associated with a card may comprise a multiplier to be applied to a payout won by the player based on the number of wins on the side (e.g., Banker or Player) on which the player wagered. For example, if a card selected by a player is associated with a 2× multiplier and the player is to otherwise receive a payout of 100 credits, the result of the 2× multiplier being applied is that the player receives a payout of 200 credits.

In another variation of a baccarat game consistent with embodiments described herein, a player may be provided an opportunity to not only wager on a side (e.g., Banker or Player) but also to wager (e.g., for an additional wager amount) on the exact range of the number of Banker or Player wins. The range may be customized by the player or selected from a menu of available predetermined ranges available in the game. If the final outcome of the game event (e.g., the number of wins for the side wagered on by the player) falls within the range selected by the player, the player may receive a higher payout than they would have received if merely placing the basic wager. If the outcome does not fall within the selected range the wager (e.g., the entire wager amount or just the wager amount attributable to the selected range) is lost.

In yet another variation of a baccarat game consistent with embodiments described herein, a player may be provided an opportunity to place a side wager in addition to the base game wager, the side wager being on a certain combination of game indicia being output on one or more paylines. The player may thus may be eligible to receive a given bonus payout for all pay lines that achieve the bonus pay outcome(s) of the side wager (e.g., Royal Flush, Straight Flush, 6 of a kind, 5 of a kind, 4 of a kind with a kicker, etc.). In another example of a side wager which may be made available, a player may be provided an opportunity to make a side wager in addition to the base game wager and receives a bonus payout for all pay lines that achieve a 6 of a Kind, with a Progressive win for 6 8's. In yet another example of a side wager which may be made available, a player may be provided an opportunity to make a side wager in addition to the base game wager and receives a bonus payout for all pay lines that achieve a 6 Aces and if all 6 Aces are Diamonds they win a Progressive. In yet another example of a side wager which may be made available, a player may be provided an opportunity to make a side wager in addition to the base game wager and receives a bonus payout for all pay lines that achieve a certain criteria such as including a predetermined number of cards comprising a predetermined characteristic (e.g., for lines which include at least 4 Red Aces or 4 Red 8s); for example a bonus may be paid for 4, 5, or 6 Red Aces or 4 Red 8s on a payline. In another variation, a bonus may be paid whenever a predetermined number of dealt cards are of a same suit and/or color (e.g., if 18 dealt cards of the base game are red (i.e. hearts and/or diamonds). In one embodiment, a bonus won may be a multiple of a player's total wager (e.g., 5×).

In one embodiment, a bonus event may comprise a randomly occurring event or an event which is triggered upon an occurrence of a qualifying condition, which may be independent from the base game. For example, the system may determine (e.g., based on a random, pseudo-random or weighted random algorithm) whether to include a Super Bonus Multiplier for a game or hand upon an initiation of each new game event (e.g., each time a player actuates a "deal" mechanism on a game interface, thus initiating a new dealing of cards into the game interface). Such a Super Bonus Multiplier event may, if it is implemented for a particular game, hand or card, cause an increase in the player's total win on (i) a given game or (ii) on any winning combination or payline that includes the particular card or symbol position affected by the Super Bonus Multiplier. In one embodiment, the multiplier to be applied to the win amount may comprise a value which is (i) predetermined and the same for all game events in which it is applied (e.g., it is always a 5× multiplier); (ii) based on one or more characteristics of a wager, game or player (e.g., based on a wager magnitude, an average wager amount of a player, a rate of play maintained by the player, a category of a player or a current level of the game); or (iii) is determined or assigned at random (e.g., randomly selected from a range (e.g., from 2 to 24) or from an available set of multipliers).

In yet another variation of a baccarat game consistent with embodiments described herein, a player may be provided an opportunity to place a fixed wager which includes each of the 288 paylines (e.g., as illustrated in FIGS. 3A through 3JJ), plus a wager for a bonus multiplier and a wager for a zero lines hit payback.

Certain aspects, advantages, and novel features of various embodiments of a baccarat game are described herein. For example, an electronic baccarat game in accordance with at least some embodiments described herein allows lower bankroll players to enjoy the game of baccarat more readily and allows for a baccarat game with more volatility, which may be attractive to some players who do not currently prefer the low volatility of conventional baccarat games. It is to be understood that not necessarily all such advantages may be achieved in accordance with any particular embodiment. Thus, for example, those skilled in the art will recognize different embodiments may be implemented or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console or terminal and/or on a mobile device such as a smart-phone or tablet computer. A game may also be playable on a dedicated gaming device (e.g., a slot machine-type of device in a brick-and-mortar casino). "Gaming" thus refers to play of a game.

A "wagering game", as the term is used herein, may comprise a game on which a player can risk a wager or other consideration. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides, or facilitates the provision of, games for play. For example, a game provider may comprise a designer, manufacturer, supplier or retailer of the game.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

A "game event", "event instance", "game instance", "hand" or "turn" is triggered upon an initiation of, or request for, at least one result of the game by a player, such as an actuation of a "start" or "deal" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game. For example, actuation by a player of a "deal" mechanism may cause an appropriate number of cards to be dealt to the player for a new hand of a baccarat game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers. References to an "award", "prize" and/or "payout" herein are intended to encompass such in the form of virtual currency, credits, real currency or any other form of value, tangible or intangible.

A "credit balance", as the term is used herein unless indicated otherwise, refers to (i) a balance of currency, whether virtual currency or real currency, usable for making wagers or purchases in the game (or relevant to the game), and/or (ii) another tracking mechanism for tracking a player's success or advancement in a game by deducting therefrom points or value for unsuccessful attempts at advancement and adding thereto points or value for successful attempts at advancement. A credit balance may be increased or replenished with funds external to the game. For example, a player may transfer funds to the credit balance from a financial account or a gaming establishment may add funds to the credit balance due to a promotion, award or gift to the player.

Referring now to the figures, FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance, hand or turn of a game, (ii) a current state or status of a game or game session (e.g., a number of wins for a particular side of a baccarat game as compared to which side the player wagered on), (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, facilitating a wager and/or a provision of a payout for a game). For example, the game server 110 may comprise a server computer operated by a game provider or another entity (e.g., a social network website not primarily directed at providing games). In some embodiments, the game server may determine an outcome for game event of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc.). In some embodiments, game server 110 may comprise two or more server computers operated by the same entity (e.g., one server being primarily for storing states of games in progress and another server being primarily for storing mechanisms for determining outcomes of games, such as a random number generator).

Turning now to a description of a player device 102, in accordance with some embodiments a player device 102 may comprise a computing device that is operable to execute or facilitate the execution of a game program and used or useful by an player for accessing an casino or other electronic (e.g., online) game. For example, a player device 102 may comprise a computing device dedicated to gaming, a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox™, Xbox One™, Sony™ Playstation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine or video terminal on a casino floor) or a non-dedicated gaming device (e.g., an iPad™). It should be noted that a game server 110 may be in communication with a variety of different types of player devices 102.

A player device 102 may be used to play a wagering or non-wagering game (e.g., a baccarat game) over a network and output information relating to the game to players participating in the game (e.g., outcomes for an event instance of the game, qualifying for a bonus round of the game, outcomes determined for a bet, a result of a bet, credit balance of credits available for play of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance or game instance (e.g., a dealing of cards for a baccarat game) has been triggered or initiated (and, in some embodiments, communicating such a trigger or initiation to game server 110), (ii) a result for a bet (e.g., which may comprise the payout won as a result of the bet), and/or (iv) modifying a game interface to reflect events within the game. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2A:
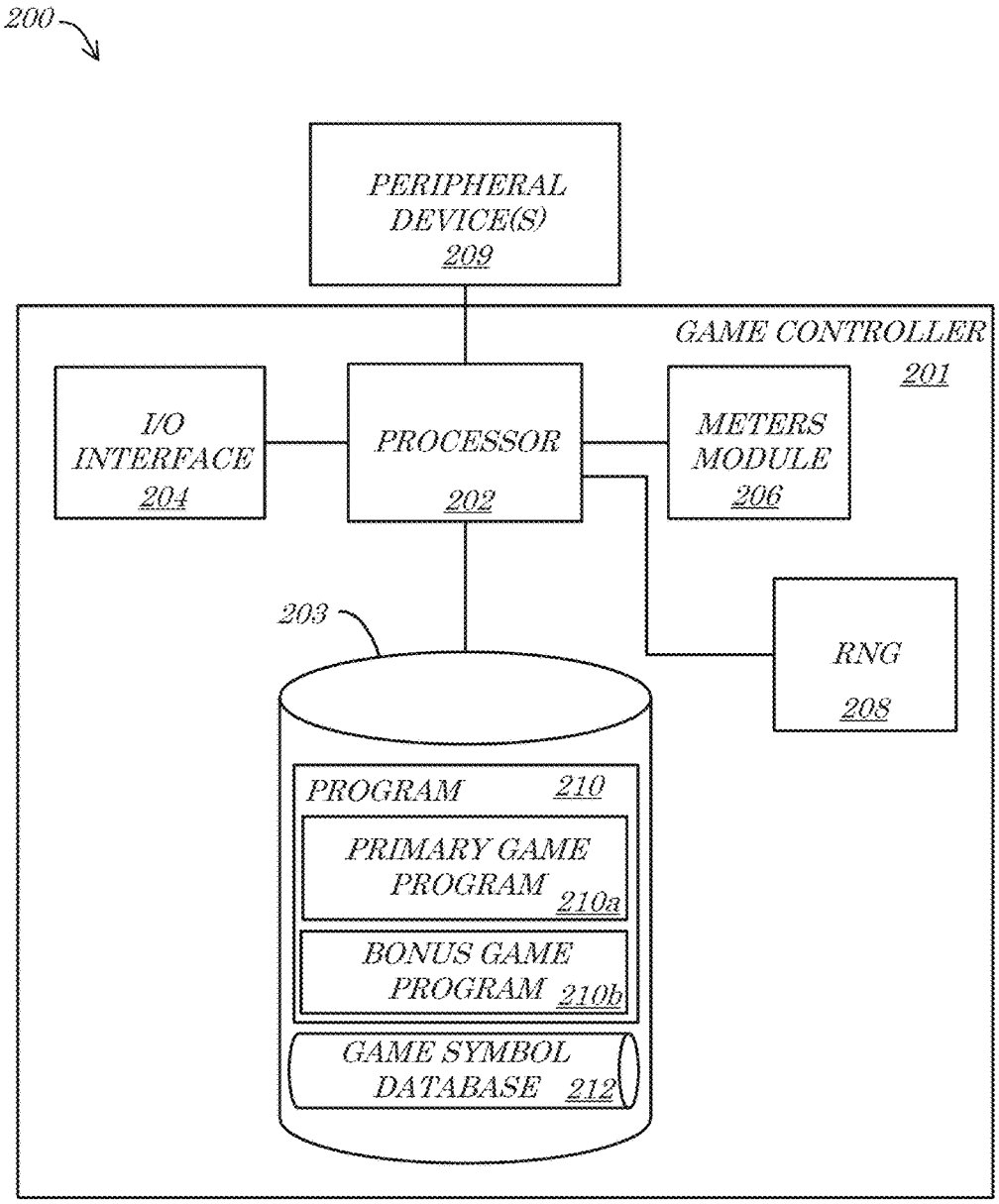
FIG. 2A is a block diagram of an embodiment of a gaming apparatus useful in at least some embodiments described herein.

Referring now to FIG. 2A, illustrated therein is a block diagram of a gaming apparatus 200 according to some embodiments. In some embodiments, the gaming apparatus 200 may be similar in configuration and/or functionality to any of the player devices 102 (FIG. 1), gaming apparatus 250 (FIG. 2B), the game server 110 (FIG. 1) and/or another device operable to facilitate the embodiments described herein. The gaming apparatus 200 may, for example, execute, process, facilitate, and/or otherwise be associated with any of the processes described herein (e.g., process 500 of FIG. 5). In some embodiments, gaming apparatus 200 comprises a dedicated gaming device, such as a console on a casino floor or a handheld console for playing a game consistent with at least some embodiments described herein. In other embodiments, gaming apparatus 200 may comprise a non-dedicated gaming device, such as a personal computer or mobile device (e.g., smartphone) via which a player may play a game consistent with at least some embodiments described herein. In yet other embodiments, gaming apparatus 200 may comprise a server device operable to facilitate a game consistent with embodiments described herein and operable to output information of the game and receive input from the player (e.g., wager selection, request for initiation of a new game event) via GUI output to a remote player device (e.g., via a web browser of the player device).

The gaming apparatus 200 comprises a game controller 201, which may be a combination of specialized software and/or hardware which together operate to facilitate an electronic baccarat game in accordance with at least some embodiments described herein. In accordance with some embodiments, the game controller 201 includes at least one processor 202. Instructions and data to control operation of the processor 202 in accordance with at least some embodiments may be stored in a memory 203. Processor 202 may be operable to communicate with memory 203 in order to implement functionality described herein. The gaming apparatus also includes an input/output (I/O) interface 204, meters module 206 and/or a Random Number Generator (RNG) 208.

Fewer or more components and/or various configurations of the components 202, 203, 204, 206 and/or 208 may be included in the gaming apparatus 200 without deviating from the scope of embodiments described herein. At least some of the components 202, 203, 204, 206 and/or 208 may be located outside of the game controller 201 in some embodiments. In some embodiments, at least some of the components of the gaming apparatus 200 may be distributed. For example, one or more of the components 202, 203, 204, 206 and 208 may be provided remotely from the game controller 201 and/or gaming device 200.

In some embodiments, the gaming apparatus 200 may additionally comprise any type or configuration of communication device (not shown) that is or becomes known or practicable. For example, the gaming apparatus 200 may include a communication device such as a Network Interface Controller (NIC), a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 202. In some embodiments, the communication device may comprise an IR, RF, Bluetooth™, and/or Wi-Fi® network device coupled to facilitate communications between the processor 202 and another device.

According to some embodiments, the processor 202 may be or include any type, quantity, and/or configuration of processor that is or becomes known. The processor 202 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 202 (and/or the gaming apparatus 200 and/or other components thereof) may be supplied power via a power supply (not shown) such as a battery, an Alternating Current (AC) source, a Direct Current (DC) source, an AC/DC adapter, solar cells, and/or an inertial generator. In some embodiments (e.g., in an embodiment in which the gaming apparatus 202 comprises a server such as a blade server), necessary power may be supplied via a standard AC outlet, power strip, surge protector, and/or Uninterruptible Power Supply (UPS) device.

In some embodiments, the components 203, 204, 206 and/or 206 may be communicatively coupled to the processor 202 (e.g., via wired and/or wireless connections and/or pathways) and they may generally comprise any types or configurations of I/O, meters, memory and RNG components and/or devices that are or become known, respectively.

The memory device 203 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), Programmable Read Only Memory (PROM) and/or Erasable Programmable Read-Only Memory (EPROM). Other examples of types of information storage devices which may be utilized include Magnetoresistive Random Access Memory (MRAM), flash RAM, Dynamic Access Memory (DRAM), Static Random Access Memory (SRAM), flash memory and ferroelectric memory (F-RAM).

The memory device 203 may, according to some embodiments, store a program 210 for facilitating one or more of the embodiments described herein, which program may include a primary game program 210*a* for facilitating a primary aspect of a game and a bonus game program 210*b* for facilitating a bonus feature of the game, which may be relevant to some embodiments. The memory device 203 further stores a game symbols database 212, which may store individual game symbols (e.g., representations of individual cards for a baccarat game) or sets of symbols (e.g., representations of possible hands of cards, to place along a payline of the game). In some embodiments, game symbol database 212, the primary game program 210*a* and/or the bonus game program 210*b* may be utilized by the processor 202 to provide output information via a GUI (e.g., such as GUI 400 of FIG. 4), to show to a player progress in a game event.

In some embodiments, additional programs or software modules may be stored in memory device 208 or otherwise accessible to processor 202. In some embodiments, one or more of the primary game program 210*a* and the bonus round program 210*b* may comprise various sub-programs, sub-routines or software modules for facilitating different functionality. For example, any of an additional program, program 210*a* and/or program 210*b* may be a stand-alone program or may be part of a program, or set of programs providing various services to a user. For example, the gaming apparatus 200 may be facilitating a game event and within a program 210*a* or 210*b*, a section or module is provided to facilitate a determining a result for a baccarat game comprising a plurality of paylines and/or determining the appropriate payout amount to provide to the player based on how many paylines had wins on the side (Player or Banker) selected by the player for the wager, which program section(s) or modules may be executed at a relevant time. In some embodiments, the memory device 203 may store an additional program which is called by the primary game program 210*a* or the bonus game program 210*b* when required such that the same additional program can be used by multiple programs. For example, the memory device 203 may store a "game engine" program to provide core services which are utilized by a number of individual game programs to save duplication of software code.

The memory device 203 may, in accordance with some embodiments, comprise different types of memory such as RAM, EPROM and/or a mass storage device. Different types of memory may be utilized for different purposes. For example, (i) RAM may be utilized to temporarily hold program files for execution by the processor 202 and related data; (ii) EPROM may be a boot ROM device and/or may contain some system or game related code; and (iii) a mass storage device may be used to store game programs, the integrity of which may be verified and/or authenticated by the processor 202 (e.g., by use of a program stored in another type of memory, such as in EPROM memory).

The I/O interface 204 may, in accordance with some embodiments, provide for communicating with a player interface (e.g., a GUI such as GUI 400 of FIG. 4) and/or one or more peripheral devices of gaming apparatus 200 (in some embodiments, one or more of the peripheral devices may be components of the player interface and the I/O interface 204 may communicate with such devices indirectly, via the player interface). In accordance with some embodiments, the I/O interface 204 and/or peripheral devices of the gaming apparatus 200 may be intelligent devices with their own memory for storing associated instructions and data for use with the player interface or the peripheral devices.

In accordance with one embodiment, the I/O interface 204 may provide for communication with an input device of the gaming apparatus 200. Such an input device may comprise, for example, a keyboard or bank of user-actuatable selector mechanisms or buttons that allow an operator of the gaming apparatus 200 to interface with the gaming apparatus 200 (e.g., by a player, an employee or other worker affiliated with either an online casino or other entity operating a system which provides games to players). In some embodiments, such an input device may comprise a mechanism configured to indicate to a remote server device an initiation or triggering of an event instance (e.g., that a player has actuated a "deal" mechanism (e.g., a "soft" or virtual button on an online game interface) and thus initiated a game event of a baccarat game), such information being provided to the apparatus 200 and/or the processor 202. In such embodiments, the input device may comprise a key or button on a keyboard or panel of the gaming apparatus 200, a link or selectable area on a screen which is selectable by a mouse or other selection mechanism or a touch-sensitive screen of a device. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a microphone, an infrared sensor, a sonic ranger, a computer port, a video camera, a motion detector, a digital camera, a network card, a Universal Serial Bus (USB) port, a GPS receiver, a Radio Frequency Identification (RFID or RF) receiver, a RF receiver, a thermometer, a pressure sensor, and a weight scale or mass balance.

In accordance with one embodiment, the I/O interface 204 may provide for communication with an output device of the gaming apparatus 200. Such an output device may comprise, for example, a display screen and/or other practicable output component and/or device that is operable to output information. Such an output device may, for example, comprise a display screen via which are output outcomes, instructions, guidance, questions or information to a player of a game. For example, the output device may output a game interface for a game which indicates an outcome of an event instance of the game, such as an outcome for a plurality of hands of a baccarat game and/or a win result for a bet dependent on a result of a plurality of hands or paylines. Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, an input device and an output device may comprise and/or be embodied in a single device such as a touch-screen display or screen.

The meters module 206 may comprise software and/or hardware operable to track and report on player credit with respect to the gaming apparatus 200. Such information may be desirable to track for various purposes such as ensuring regulatory compliance and determining profitability of the gaming apparatus.

The RNG 208 may comprise hardware and/or software operable to generate and/or store random or pseudo-random numbers for use by the processor 202. For example, as described herein, processor 202 may determine a random or pseudo-random number for use in determining which game elements to place into the game element positions of a game interface in order to indicate a result of a game event. In some embodiments a single random or pseudo-random number may be determined and used for a particular game instance which includes a plurality of hands and/or paylines while in other embodiments an individual random or pseudo-random number may be determined and used for each hand or payline of a game instance which includes a plurality of hands or paylines. For example, in one embodiment RNG 208 comprises an algorithm which generates random or pseudo-random numbers for use in the game. In other embodiments, gaming apparatus 200 may not include a local RNG and processor 202 may instead obtain random or pseudo-random numbers from a remotely located RNG (e.g., an RNG located at a remote server with which gaming apparatus is operable to communicate).

The gaming apparatus 200 may function as a computer terminal and/or server of an online casino or other entity operating to provide online games, receive and/or manage information related to online games. In some embodiments, the gaming apparatus 200 may comprise an apparatus that is operable to interact with a player of an online game. In some embodiments, gaming apparatus 200 may comprise a plurality of devices working together to accomplish the functionality described herein with respect to FIG. 2A.

Any or all of the exemplary instructions and data types described herein and other practicable types of data may be stored in any number, type, and/or configuration of memory devices that is or becomes known. The memory device 203 may, for example, comprise one or more data tables or files, databases, table spaces, registers, and/or other storage structures. In some embodiments, multiple databases and/or storage structures (and/or multiple memory devices 203) may be utilized to store information associated with the gaming apparatus 200. According to some embodiments, the memory device 203 may be incorporated into and/or otherwise coupled to the gaming apparatus 200 (e.g., as shown) or may simply be accessible to the apparatus 200 (e.g., externally located and/or situated).

In some embodiments, the game controller 201 may further be operable to communicate with one or more peripheral devices 209. Examples of such peripheral devices include displays, touch screens, a bank of physical buttons of a gaming console, a card and/or ticket reader, a printer, a bill acceptor and/or coin input mechanism, and a currency output mechanism.

In some embodiments, gaming apparatus 200 may include additional components such as a communications interface which functions to allow the gaming apparatus 200 to communicate with other components of a gaming system. For example, the gaming apparatus 200 may include a network card. The network card may, for example, send to and/or receive from another device information, instructions and/or data. Such information, instructions and/or data may relate to, for example, status (e.g., of a player and/or game) or accounting (e.g., for a particular player and/or the gaming apparatus 200). Such other device may comprise, for example, a specialized server device of a casino operator. Additional hardware may be included as part of the gaming apparatus, or hardware may be omitted, as desired for the specific implementation.

Figure 2B:
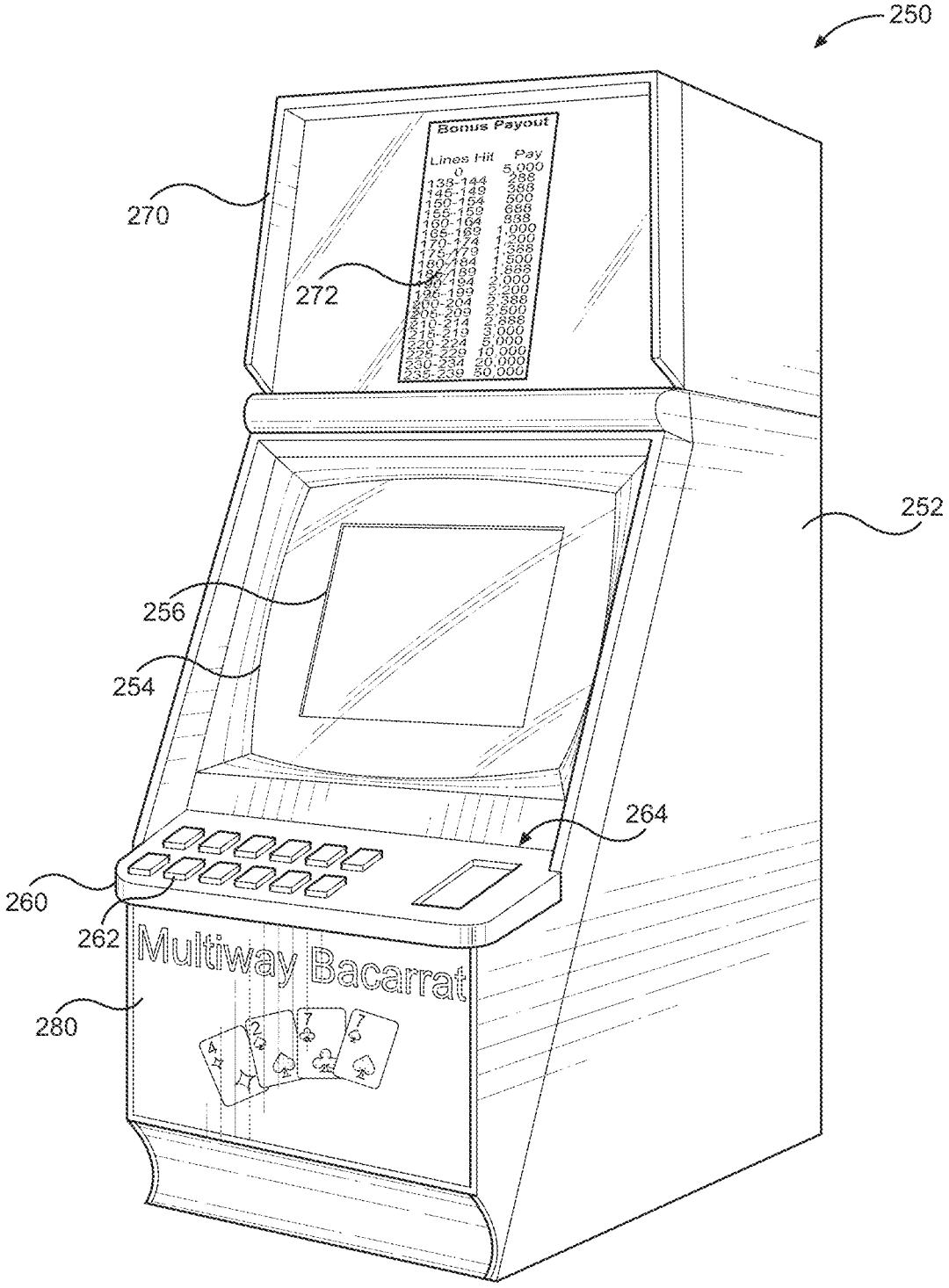
FIG. 2B is a schematic diagram of an embodiment of a gaming apparatus useful in at least some embodiments described herein.

Referring now to FIG. 2B, illustrated therein is an example gaming apparatus 250, which comprises an example of a player device embodied as a dedicated gaming apparatus, such as may be found on a casino floor, which may specially function to provide at least some of the embodiments described herein. In one embodiment, gaming apparatus 250 comprises a player device 102 (FIG. 1) and/or gaming apparatus 200 (FIG. 2A).

In accordance with some embodiments, the gaming apparatus 250 may include a console 252 having a display 254 on which is displayed representations of a game 256 that can be played by a player in accordance with the embodiments described herein. The display 254 may, in some embodiments, comprise a touch screen operable to receive input from a player. In accordance with some embodiments, one or more areas of a GUI output to a player may comprise respective input mechanisms, such as interactive virtual buttons on a touch screen which allow a player to make selections or provide input to the game. In accordance with some embodiments, the display 254 may be operable to output a GUI such as the example GUI 400 illustrated in FIG. 4.

Section 260 of the gaming apparatus 250 includes a set of input mechanisms a bank of buttons 262. Mechanical buttons 262 comprise another example input mechanism for enabling a player to interact with the gaming apparatus (e.g., to provide selections or input during game play, such as selection of a wager and/or request for an initiation of a new game instance or dealing of a plurality of hands into a game interface). Mechanical buttons 262 may be used in place of or in addition to input mechanisms on a touch screen. Section 260 may also, in some embodiment, include at least one monetary input mechanism 264 for allowing a player to input currency, credit or other information (e.g., financial account information) in order to establish funds with the gaming apparatus such that the player may wager on the game playable on the gaming apparatus 250. For example, the at least one monetary input mechanism 264 may comprise at least one of (i) a coin input chute; (ii) a bill collector; (iii) a card reader for reading a smart card, debit card or credit card; (iv) am RFID reader device for reading information from an RFID-enabled currency mechanism of the player (e.g., an RFID-enabled credit or debit card, an RFID-enabled portable memory device which stores fund information for the player, etc.); and (v) a ticket-in/ticket-out mechanism for receiving and/or outputting printed receipts or other printed media which a player may utilize to establish funds with the gaming apparatus. In some embodiments, section 260 may further include other components, such as a reading device operable to read a player tracking card or other device (e.g., a magnetic stripe card, flash drive or any other portable storage medium capable of being read by the reading device).

A top portion 260 of the gaming apparatus 250 may output or have displayed thereon, in area 272, artwork or information regarding the game. In the particular embodiment of FIG. 2B, area 272 is being utilized to output a bonus payout schedule consistent with some embodiments described herein and corresponding to the example bonus payout schedule included in area 406 of GUI 400 (FIG. 4). Additional information and/or artwork may be displayed or output on a front panel 280 of the console 252. In some embodiments, the console 252 may include additional components not illustrated in FIG. 2B. For example, console 252 may include a coin tray, a ticket or receipt printer and/or a bill dispenser.

Referring now to FIGS. 3A through 3JJ, illustrated therein are 288 paylines which may be utilized in an electronic baccarat game in accordance with one or more embodiments described herein. Of course any number of paylines or hands greater than one may be utilized, as desired, and the number 288 is utilized in the present description as merely one illustrative example. As described herein, in accordance with some embodiments a player's payout for a game event may be based on how many wins there are attributable to the side the player wagered on (Player or Banker).

The paylines of FIGS. 3A through 3JJ illustrate a mechanism in accordance with which cards displayed in a symbol matrix may be evaluated to determine, from a plurality of possible paylines or hands dealt for a given game event or wager, the number of wins for the Banker Side and the number of wins for the Player side. In accordance with one example embodiment, each payline of FIGS. 3A through 3JJ is illustrated in the context of a symbol matrix comprising six columns and three rows. Each of the rows represents symbol positions for cards dealt to form a given hand. The first three symbol positions (left-to-right) of each row are for cards attributable to the Banker side while the last three symbol positions of each row are for cards attributable to the Player side. Each column may, in accordance with some embodiments, be considered akin to a reel in a slot machine game, having element positions to be populated with game elements or indicia comprising cards. In accordance with some embodiments, the game elements to be placed into each hand or along each payline for a given game instance or wager: (i) may be associated with their own electronic shoe (e.g., an 8 deck shoe) or RNG from which the cards are dealt or determined for that hand; (ii) may be determined based on an distinct output obtained from an electronic shoe or RNG (but the same electronic shoe or RNG may be used to obtain more than one output for more than one payline); or (iii) may be determined based on a single output from an electronic shoe or RNG for the whole of the wager or game instance (e.g., individual hands may be determined based on the single RNG output via a different process).

Once all six cards for each hand are determined (and, in some embodiments, populated into the symbol matrix) in accordance with embodiments described herein, each of the 288 available paylines is evaluated to determine an appropriate payout to provide to the player, based on the side on which the player wagered and the number of wins attributable to that side based on the evaluation. Again, it should be noted that while 288 paylines are illustrated, other numbers of paylines may be utilized, with the appropriate adjustments to the number of rows or hands.

As can be appreciated from a review of FIGS. 3A through 3JJ, each payline 1-288 comprises a hand (consisting of three cards attributable to the Banker side and three cards attributable to the Player side). To determine whether a hand is a Banker win or a Player win, the three cards attributable to the Banker side along a given payline may be attributed a point value (e.g., as described above, in some embodiments this may be done based on a traditional baccarat game card valuing methodology) and the three cards attributable to the Player side along a given payline may be attributed a point value. The point values for the Banker side are then summed, as are the point values for the Player side. The highest point value sum, or the point value sum closest to 9, may be considered the winning side. As can further be appreciated from a review of the 288 example paylines illustrated in FIGS. 3A through 3JJ, although a payline may comprise element positions which are adjacent to one another or diagonal to one another (e.g., see paylines 32-36), a payline may also consist of element positions which are not adjacent to one another (e.g., see paylines 287 and 288), thus allowing for a large number of possible hands or paylines, which may result in a game of higher volatility.

As described herein, one mechanism for populating a symbol matrix may comprise populating a single card into each symbol position of the matrix upon a game initiation event (e.g., a player actuates a "deal" command in a game interface of the game). In such an embodiment, some or all of the cards placed into symbol positions may initially be dealt face-down. In some embodiments, the values of the face-down cards may be revealed (e.g., the cards may be virtually flipped over) initially only for a sub-set of the cards (e.g., for the first two cards of each side). As also described herein, in some embodiments not all symbol positions may initially be populated. For example, in one embodiment only two of the three symbol positions attributable to a player side and two of the three symbol positions attributable to the banker side for a given hand may initially be populated (e.g., an additional third card may be added to the third available position of each hand if the player or game rules provide for a dealing of the third card).

In other embodiments, a process for populating a symbol matrix may be modified in various other manners to add different features or interest to the game. For example, in accordance with some embodiments, not all rows of a symbol matrix may be populated at the initiation of a game and/or not all symbol positions may be populated based on a random or pseudo-random algorithm. For example, in one embodiment only the symbol positions in a subset of the rows may be initially populated with randomly determined cards (e.g., in a symbol matrix comprising three rows, only the middle row may initially be populated with randomly determined cards). The player may then be provided an opportunity to select a specified predetermined number of cards to be held. Such player selection may be allowed after the values of the dealt cards are revealed to the player or before. The number of cards a player is allowed to hold may be configurable (e.g., by the game provider and/or based on a characteristic of the wager, such as a magnitude of the wager). The number of cards a player is allowed to hold may, in some embodiments, be the same for each of the player side and banker side. In other embodiments, the number may be different for the player side and the banker side. Once the player selects which cards are to be held, the held cards (or at least the values thereof) are replicated into symbol positions of at least one other row of the symbol matrix (e.g., into both the top row and the bottom row, in a three row matrix). Symbol positions which are not populated with the held cards (or replications of the held cards) may then be populated via a random or pseudo-random process. In another variation, a player may be allowed an opportunity to select one card from all cards which are initially dealt face-down (e.g., nine cards populating three hands may initially be dealt). In one embodiment, the player may only be allowed to select a card from the side on which they wagered. The selected card may then be revealed (e.g., virtually flipped over) for the hand in which it was placed and also replicated into one or more additional hands (e.g., all the remaining hands or the hands directly above and below), in the symbol position in the same vertical column. The remaining cards may then be revealed and the game outcome determined. In one embodiment, a player may be allowed to modify or switch a position of a dealt card (e.g., after some or all of the placed cards have been revealed). For example, in one embodiment a player may be provided with an opportunity to move one or more cards (e.g., within a single hand or between hands) from a banker side to a player side or vice versa. In one embodiment a time constraint may be used (limiting the amount of time a player has to make such changes to card positions).

Other features may also be added to a baccarat game as described herein, to provide for additional excitement, anticipation, interest and/or winning opportunities. For example, in some embodiments one or more special designations for one or more cards or symbol positions may be employed, the special designations corresponding to specific attributes, functionalities or benefits to be provided during game play.

In one embodiment in which a special card or designation is utilized to provide a specific attribute, benefit or functionality to be provided during game play, a wild card feature may be employed. A wild card may comprise a card or other game indicia (which may, in some embodiments, be one of the regular cards in a deck of cards used in the game or in other embodiments may be a special card not otherwise used in the deck) which is designated as "wild", meaning that when this card is included in a hand it will take on the value that is necessary to cause the hand to have a specified result, such as the value necessary to create a natural win or a tie. In one embodiment, a wild on each side may be determined to create a tie, 1 wild on one side may be determined to create a win on that side; and in event there are 2 wilds on one side and 1 wild on the other side, then the side with 2 wilds would win. In some embodiments a particular card may be designated as a wild card for a game as part of the rules of the game (e.g., there is a special "wild" card in the deck, all Jokers are "wild", all 4s are "wild" or "4 of hearts" is "wild"). In other embodiments, which card is designated as wild may be modified (e.g., a different card may be designated as wild at the beginning of each deal, each hand, each session or another game event).

In another embodiment in which a special card or designation is utilized to indicate a specific attribute, benefit or functionality to be provided during game play, a game may include a possibility of a "lucky" symbol or designation to appear in some hands (e.g., in a specific symbol position or otherwise in association with a specific symbol position or card). Of course, the term "lucky" is utilized herein for illustrative purposes only and any name, term, symbol or indication may be utilized to indicate that a particular card or symbol position is associated with a special attribute, functionality or benefit and different terms or names may be used to indicate different attributes, functionality or benefits. A "lucky" card or designation may, for example, be an indication that the associated card (whether it be a specified card or any card which is placed into such a specially designated symbol position) causes a bonus, benefit, potential benefit, or additional winning opportunity to be provided to the player. For example, in one embodiment a special symbol which designates a card as a "lucky" card may appear over a card, on a card or in a symbol position (or otherwise in association with a card or symbol position), thus indicating that the card in this symbol position corresponds to a special attribute for purposes of a current hand (or, in other embodiments in which such a designation is persistent for more than one hand, for purposes of a certain amount of time, a specified number of hands, or until a certain condition is met).

One example of a special attribute which may be indicated by an output of a "lucky card" designation is that a multiplier n will be applied to any payout or other prize to which the specially designated card contributes. The value of n may, in accordance with some embodiments, (i) be a predetermined value; (ii) be a value which may be based on one or more characteristics of a wager, game or player (e.g., based on a wager magnitude, an average wager amount of a player, a rate of play maintained by the player, a category of a player or a current level of the game); or (iii) be assigned at random (e.g., randomly selected from a range (e.g., from 2 to 24) or from an available set of multipliers).

Another example of a special attribute which may be indicated by an output of a "lucky card" designation is an instant win type of reward, which causes an instant win of a specified magnitude x to be provided to the player (e.g., regardless of whether the player wins the hand in which the specially designated card is included or, in other embodiments, only if the player wins the hand in which the specially designated card is included). The value x of the instant win may be determined, for example, using any of the methodologies described above with respect to the multiplier n.

Yet another example of a "lucky card" attribute is that an appearance of the "lucky card" designation causes an addition of value to a meter, progressive award or other running count. For example, a particular "lucky card" designation may be a "Pot of Gold" symbol which, when present, causes a deposit of virtual gold coins into a virtual pot (or vault or virtual account) that is displayed on screen to the player, which the player may eventually win based on other events in the game. For example, a game outcome may trigger a bonus round in which the player may select symbols (cards, images, numbers, etc.) in order to determine the amount of win for the bonus round, which amount may be based on the accumulated value in the "Pot of Gold" prior to the triggering of the bonus round.

Another example of a special attribute which may be indicated by an output of a "lucky card" designation is that the specially designated card functions to modify or adjust a point value of a hand or side of a hand, as needed to cause the point value to be a specified point value or within a specified category of hand results. For example, including such a specially designated card in a hand may function to cause the value of the card to be changed or modified, or take on a plurality of values (each respective value for purposes of calculating a point value for a hand in which the card is included), such that every payline that includes the specially designated card creates a point value of 9 for the side on which the player has placed a wager (similar to the functionality of a wild card). In accordance with some embodiments, at least one card is chosen at random from the dealt cards to be associated with such a designated functionality.

Other variations and modifications to aspects of a baccarat game as described herein may be implemented. For example, in one embodiment a game may only provide a payout or win for a player for only a specified subset of possible winning outcomes. For example, only natural wins (i.e., a hand with a value of 8 or 9) may qualify towards a payout and all other outcomes are discarded. In one embodiment of such a variation, each natural win may pay a multiplier based on the point value of the hand, whether 8 or 9, (such that an 8 might pay a 3 multiplier, and a 9 might pay a 4 multiplier). In some embodiments, there may also be a payout for the overall number of natural wins or other qualifying wins.

In accordance with some embodiments, systems, methods and articles of manufacture (e.g., non-transitory computer-readable media) provide for: (i) providing an interface for a game of baccarat, the interface comprising a symbol matrix comprising a plurality of symbol positions arranged in a grid having a plurality of rows (e.g., three rows) and a plurality of columns (e.g., six columns), each symbol position for placement of a single card, and further wherein a predetermined number of symbol positions (e.g., six symbol positions) bearing a predetermined positional relationship among one another comprise a payline such that a plurality of paylines (e.g., 239 paylines) are formed within the symbol matrix and wherein a first subset of the symbol positions along a given payline (e.g., the first three symbol positions left-to-right) are attributable to a Banker side and a second subset of symbol positions along the given payline (e.g., the last three symbol positions left-to-right) are attributable to the Player side, all of the symbol positions along the given payline together constituting a hand of the baccarat game; (ii) receiving an indication that a player has placed a wager on one of the Banker side and the Player side; (iii) populating the symbol matrix with cards, such that a single card is placed into a single symbol position, thereby facilitating a new game event of the game; (iv) evaluating each payline to determine, for each payline of the plurality of paylines, whether the Banker side or the Player side wins the hand along the payline, thereby determining a first number of wins for the Banker side in the game event and a second number of wins for the Player side in the game event; and (v) determining a payout value to provide to the player based on (a) which side (Player or Banker) the player wagered on, and (b) one of the first number or the second number.

In accordance with some embodiments, populating the symbol matrix with cards may comprise populating the symbol matrix based on data associated with at least one of (i) live game play data; (ii) historical game play data; and (iii) an RNG. In accordance with some embodiments, each hand of cards may be associated with at least one of its own electronic shoe of cards or its own RNG or RNG output. In accordance with some embodiments, evaluating each payline may comprise determining a first sum point value for the cards in the first subset of symbol positions of the payline, determining a second sum point value for the cards in the second subset of symbol positions of the payline and determining a win for the side corresponding to the higher of the first sum point value and the second sum point value.

Referring now to FIG. 4, illustrated therein consistent with one embodiment there is provided a graphical user interface (GUI) 400). The graphical user interface 400 is arranged to display information regarding a program, software application or other element associated with a computing device. In accordance with one embodiment, the GUI 400 is associated with a program comprising one or more sub-routines, modules or functions. In one embodiment, GUI 400 is associated with a program for facilitating an electronic baccarat game consistent with at least some embodiments described herein and playable by a user via a player device (e.g., a dedicated player device such as that illustrated in FIG. 2B or a non-dedicated player device such as a smart phone or tablet computer). For example, GUI 400 may be associated with program 210 (FIG. 2A), as described in more detail herein. In one more specific example, in some embodiments a player device may access a server device as a client via a browser on the player device and the player may play a game consistent with at least some embodiments described herein by accessing the game interface using a browser rather than having game logic downloaded to the player device. Thus, in some embodiments GUI 400 may comprise a game interface output in a display of a player device via a web browser of the player device, the information displayed therein being modified by a server device of a game provider.

In accordance with some embodiments, GUI 400 may be arranged to display information associated with a program for facilitating an electronic baccarat game consistent with at least some embodiment described herein and permit interaction with (e.g. provide input to the program), whether directly or indirectly, the computing device which is running or performing the program. In one embodiment, the GUI 400 comprises a mechanism for one or more computing devices to output game data to a player via a display of a player device (e.g., by displaying the GUI 400 via a web browser of the player device) and/or receive data from a player, and thereby perform one or more programs or sub-routines for facilitating an electronic baccarat game comprising multiple paylines. For example, some elements of the GUI 400 may comprise input mechanisms (e.g., virtual buttons or links actuatable by the player via a cursor or via a touch if the GUI 400 is being displayed via a touchscreen of a player device) and the inputs provided by the player to the GUI 400 may be transmitted to the computing device (e.g., gaming apparatus 200) which is operable to determine data and progress in the game based on the inputs (e.g., a computing device operable to perform process 500, described herein).

In accordance with one embodiment, GUI 400 may comprise a plurality of windows or areas of a variety of shapes and sizes (which shapes and sizes may be modified during a course of a game event, to allow for clearer representations of information to a player). In the example of FIG. 4, GUI 400 includes a first window 402 in which there is displayed a symbol matrix comprising eighteen (18) symbol positions into which cards may be placed, arranged in three rows of six symbol positions. Also displayed in window 402, in the center section between the first three columns and the last three columns (left-to-right) is information regarding a result of a given game event, such as (i) an area 402*a* which summarizes, after cards are populated into the symbol matrix for a given game instance, the number of Banker Side wins, the number of Player side wins and the number of Ties; (ii) an area 402*b* which indicates the wager amount for the present game instance; (iii) an area 402*c* which indicates the number of paylines for which the side the player wagered on for the present wager (Banker or Player) was the winning side; (iv) an area 402*d* which indicates the amount of a bonus payout win based on the number of wins in (iii); (v) an area 402*e* which indicates the total amount won by the player for the present game instance, based on (iv) and any additional amounts appropriate for the wager (e.g., number of ties, an extra bonus payout, etc.); and (vi) an area 402*f* which indicates the amount of funds (or credit meter balance) the player currently has as available for wagering on the electronic baccarat game.

Window or area 404*a* of GIU 400 comprises a player-selectable mechanism for selecting the Banker side as the side the player would like to wager on for purposes of the present game event. Window or area 404*b* comprises a player-selectable mechanism for selecting the Player side as the side the player would like to wager on for purposes of the present game event. A player may, in some embodiments, be required to select either Banker (utilizing player selectable mechanism in area 404*a*) or Player (utilizing the player-selectable mechanism in area 404*b*) before cards are populated (or at least before a sufficient number of cards is revealed in GUI 400 to provide an information or an advantage to a player as to which side is likely to have a higher number of wins). The player-selectable mechanisms in areas 404*a* and 404*b* may comprise, for example, touch-sensitive areas on a touch screen or areas selectable via a cursor and mouse mechanism of a player device. In one embodiment in which a player device comprises a dedicated gaming device, the player-selectable mechanisms for selecting either a Banker side or a Player side for a given wager may be embodies as physical buttons in a bank of buttons of a console comprising the gaming device.

Window 406 is, in accordance with some embodiments, outputting a bonus payout schedule indicating how many credits a player may win, depending on how many wins correspond to the side the player wagered on (Banker or Player). In accordance with some embodiments, the bonus payout schedule in window 406 is utilized irrespective of which side the player selected for the wager. In other embodiments, a first payout schedule may be utilized to determine a payout amount for Banker side wins and a second payout schedule may be utilized to determine a payout amount for Player side wins. In accordance with some embodiments, the bonus payout schedule in window 406 consists of a plurality of ranges of number of wins and a corresponding bonus payout amount for each range. It should be noted that, in accordance with some embodiments, a relatively high payout amount (5,000 credits) will be awarded to the player if zero (0) paylines correspond to a win on the side the player selected (e.g., if the player wagered on Banker and none of the paylines result in a Banker side win, the player is awarded 5,000 credits). This is because of the relatively long odds of such an occurrence.

Window 408 is, in accordance with some embodiments, outputting a secondary bonus payout schedule, which specifies particular payout amounts to be awarded to the player if a specific corresponding number of wins result for the side the player wagered on. In the example of FIG. 4, the secondary bonus payout schedule provides for only the following four (4) bonus payouts: (i) 500 credits are awarded if a result of a game instance is that exactly 128 paylines have a win for the side the player wagered on; (ii) 888 credits are awarded if a result of a game instance is that exactly 138 paylines have a win for the side the player wagered on; (iii) 8,888 credits are awarded if a result of a game instance is that exactly 228 paylines have a win for the side the player wagered on; and (iv) 50,000 credits are awarded if a result of a game instance is that exactly 238 paylines have a win for the side the player wagered on. In accordance with some embodiments, the numbers 128, 138, 228 and 238 may have been selected for additional payout amounts because they are considered lucky numbers in some cultures in which the game is deployed. Of course, bonuses for particular numbers of wins may be selected based on any desired premise or factor.

Returning to window 402, it can be seen that in the example game instance used for illustrative purposes only, the particular placement of the particular game symbols illustrated resulted (as indicated in area 402*a*) in (i) 180 Banker side wins (i.e., 180 paylines resulted in the Banker side of the hand being the winning side), (ii) 49 Player side wins (i.e., 49 paylines resulted in the Player side of the hand being the winning side) and (iii) 10 Ties. It may be assumed, for purposes of the example of FIG. 4, that the player who is participating in the present game instance selected the Banker side when placing his wager. It may further be assumed that the rules of the game award two (2) credits per wining payline for each credit wagered and one (1) credit per tie, in addition to any bonus payout the player may win as a result of either the Bonus Payout schedule of area 406 or the Extra Bonus Payout schedule in area 408. Accordingly, upon a revealing of the cards placed into the symbol matrix of area 402, GUI 400 indicates that for purposes of the present example: (i) the player wagered 500 credits (area 402*b*); (ii) 180 payline wins are attributed to the side the player wagered on (the Banker side in the present example; area 402*c*); (iii) the player has won a bonus payout of 1,500 credits (area 402*d*, derived using the Bonus Payout schedule shown in area 406, in which it can be seen that 180 is within the range 180-184, which corresponds to a bonus payout of 1,500 credits; and (iv) that the player has won, as a result of the present game instance, a total of 1,870 credits (area 402*e*). The 1, 870 credits is derived, in accordance with some embodiments, as follows:

$$(180\times2)^{*}+1{,}500^{}+10^{*}=1{,}870$$

* two credits for each payline which has a win on the side the player wagered on (Player or Banker), which in this case is 180 wins for the Banker side;

bonus payout from schedule in area 406**

*** one credit per Tie, which in this case is ten (10)

Area 402*f* indicates the number of credits the player has available for wagering on the game (e.g., after the 1,870 credits won as a result of the present game instance are added thereto).

Figure 5:
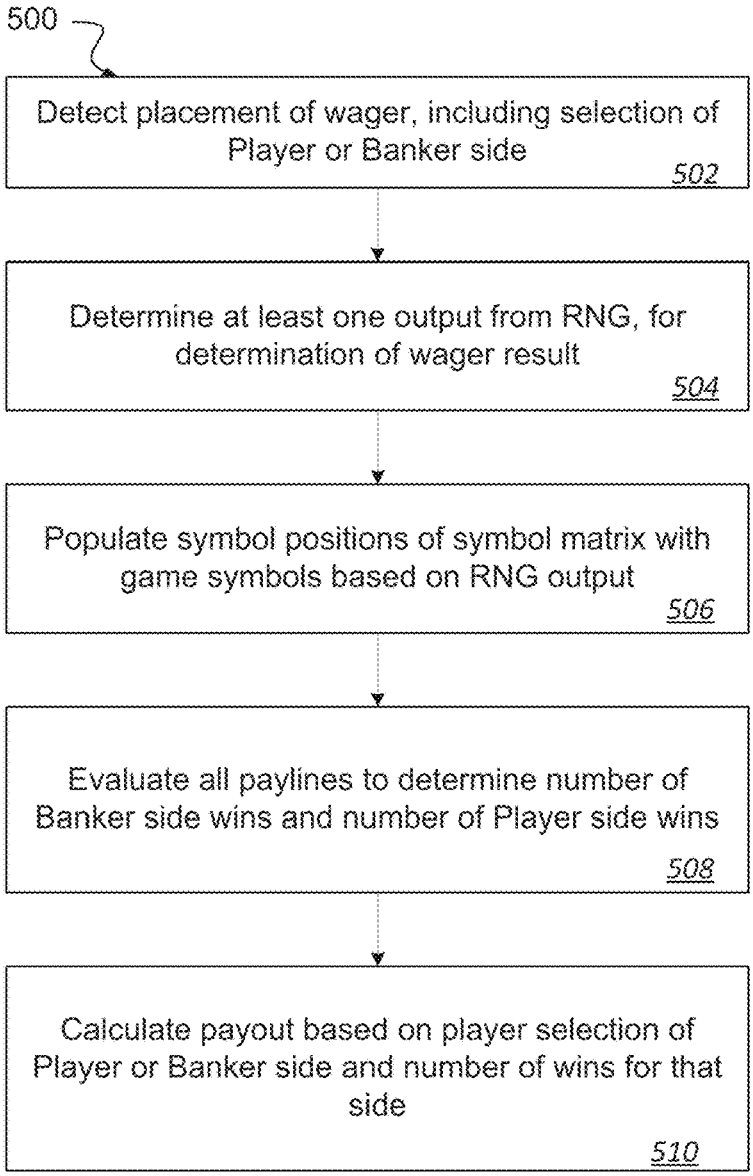
FIG. 5 is a flowchart illustrating a process according to one or more embodiments described herein.

Turning now to FIG. 5, illustrated therein is a process 500 for implementing some of the embodiments described herein. The process 500 may comprise respective processes for implementing the multi-payline wager for a baccarat game described herein. The process 500 may be performed, for example, by at least one of a server device operable to facilitate an electronic baccarat game and/or a player device enabling a player to play the electronic baccarat game. For example, the process 500 may be performed by at least one of (i) a player device 102 (FIG. 1); (ii) a game server 110 (FIG. 1); (iii) a player device 202 (FIG. 2A); and (iv) a player device 250 (FIG. 2B). It should be noted that additional and/or different steps may be added to those depicted and that not all steps depicted are necessary to any embodiment described herein. The process 500 is an example process of how some embodiments described herein may be implemented, and should not be taken in a limiting fashion. A person of ordinary skill in the art, upon contemplation of the embodiments described herein, may make various modifications to process 500 without departing from the spirit and scope of the embodiments in the possession of applicants.

The process 500 will be described with reference to FIG. 4, which comprises an example GUI which may be output to a player in accordance with some embodiments described herein and facilitate the implementation of process 500.

Turning now to FIG. 5, process 500 begins in step 502 with detecting a placement of a multi-payline baccarat wager and selection by the player of the Banker or Player side, which is to be used for calculating the appropriate payout for the game instance. For example step 502 may comprise determining that a player has selected a wager amount, has selected (via a player-selectable mechanism) one of the Player or Banker side and has actuated a mechanism for initiating the dealing of the cards (e.g., determination of the cards to be placed into the symbol matrix for the game instance). In some embodiments, selection of the Player side and Banker side and initiation of the dealing of cards may comprise one input (e.g., the actuation of either a "Player" button or a "Banker" button may cause cards to be dealt into the symbol matrix). Various manners of receiving an indication of a wager placement by a player are known and need not be described in detail herein.

In step 504, at least one output from an RNG is received, for purposes of determining a result for the wager. In one embodiment, a different number or other output from an RNG may be received for each payline and/or symbol position. In other embodiments a single number or other output may be received from the RNG for the game instance and used to determine particular cards or other symbols to place into the symbol matrix to indicate the result corresponding to the number or output. An output of an RNG may comprise a random or pseudo-random number or output determined based on an algorithm. In some embodiments the RNG may be a component of a gaming apparatus or other computing device performing at least some steps of process 500 while in other embodiments it may be a component of another device. For example, upon determining that a new wager has been placed, the apparatus performing process 500 may be programmed to request at least one output from an RNG, whether local or remote. As described herein, in some embodiments an electronic shoe and/or live game play data may be used in place of an RNG to determine at least one output based upon which the particular cards to place into the symbol matrix of the game are determined.

In step 506, particular game symbols (e.g., particular images of cards) are selected and placed into the symbol positions of the symbol matrix based on the one or more RNG outputs determined in step 504. In some embodiments all six symbol positions of at least one given payline may initially be populated while in other embodiments only a subset of the symbol positions of one or more paylines may initially be populated (e.g., four of the six symbol positions of at least one of the paylines may be populated). In embodiments in which only a subset of the symbol positions of at least one payline are initially populated, if it is later determined that another symbol is to be placed into a symbol position of the at least one payline, another output from an RNG or other source may be requested and the appropriate symbol to place may be determined based thereon.

In some embodiments, as described herein, only a subset of the symbol positions for a given row are initially populated and a player may be provided with an opportunity to pick the one or two cards (which are face down when the player selects them, such that the player is not aware of the value of the cards) to fill the remaining one or more symbol positions in each row which are not filled with cards based on an initial dealing of cards for the hand. For example, the player may be allowed to select the one or two cards needed to complete four and five card hands to make them six card hands. For example, once the initial deal of the four or five cards is output to the player the player may be provided with an interface on which is output a matrix of available face down cards for the player's selection (e.g., the benefit or value of the card may be revealed to the player after the player selects the card). In some embodiments, the point value of these cards will be 0, however some of them will also have a benefit (e.g., a multiplier) associated with them. In such embodiments, process 500 may include at least one additional step of receiving from the player a selection of the one or more additional cards to place into the symbol matrix (and may also include additional steps of determining a set of cards to make available to the player for selection, such as based on an RNG output, and outputting these cards to the player for selection). Once the player selects the one or more additional cards, these cards may be placed into the appropriate positions of the symbol matrix.

In step 508, the paylines of the symbol matrix are evaluated to determine the number of Player side wins and the number of Banker side wins (and, in some embodiments, the number of Ties). For example, as described herein, in some embodiments each payline consists of a baccarat hand which includes at least two cards attributable to a Banker side and at least two cards attributable to the Player side and evaluating a payline to determine which side is the winning side may comprise determining a point value for each side in accordance with traditional baccarat rules, then comparing the values to see which is higher. It should be noted that step 508 may be performed prior to any of the cards (or at least all of the cards) being revealed to the player. In other words, the gaming apparatus or other computing device performing process 500 may determine a result for the current game instance (e.g., how many Player side wins, how many Banker side wins, how many Ties) prior to revealing the cards and/or result to the player. In some embodiments, as described herein, there may be a need to place additional cards into the symbol matrix after an initial evaluation of the paylines (e.g., to place a third card after two cards have initially been placed into at least one of the Player side or the Banker side of at least one payline). A placement of an additional card may be due to, for example, a rule of the baccarat game or to determine a bonus for use in the determination of a payout of the baccarat game. In such embodiments, process 500 may include an additional step of placing at least one additional card into the symbol matrix after an initial evaluation of the paylines.

In step 510, the total payout for the present game instance is calculated based at least on which side the player selected for the current wager (Player or Banker) and the number of wins for that side. For example, as illustrated in FIG. 4, in one embodiment a payout for the game instance may be calculated by summing the following: (i) a predetermined number of credits (e.g., two) per payline for which the win is attributable to the side the player wagered on; (ii) a second predetermined number of credits (e.g., one) per Tie; (iii) a first bonus payout based on which range of numbers from a plurality of number ranges that the number of wins attributable to the side the player wagered on fits into; and (iv) a second bonus payout amount if the number of wins attributable to the side the player wagered on is equal to a predetermined special bonus number (e.g., 238).

The particular method for calculating a payout based on the number of wins attributable to the side on which the player wagered on illustrated in FIG. 4 is one example method only. Other methodologies may be used to determine a payout based on the number of paylines which have wins attributable to the side the player wagered on are contemplated and described herein. The embodiments described herein are not dependent on any particular mechanism for awarding payouts based on the number of paylines which have wins corresponding to the side the player wagered on (Player or Banker) in a multi-payline baccarat game. For example, in one alternate embodiment, different ranges of number of wins may correspond to different multipliers which are to be applied to a primary payout for a game instance. In another alternate embodiment, a bonus wheel game mechanic may be used to award bonus payouts based on the number of wins corresponding to the side the player wagered on. For example, different ranges of number of wins may activate different jackpot wheels (e.g., with increasing prize values or relatively more high value prizes available on the different jackpot wheels). In one embodiment, one or more bonus wheels may be dynamically populated with available prizes based on the number of wins achieved by the player (e.g., prizes (or higher value prizes) may be added to or removed from the wheel(s) depending on the range of number of wins). A bonus jackpot wheel may then be spun to determine the bonus payout won by the player, as a secondary feature of the game once the number of wins obtained by the player has been determined for a given game instance.

Provided below is one example bonus payout paytable utilizing different jackpot wheel levels corresponding to different ranges of wins:

| Hands Won | Award |
|---|---|
| 287-288 | Jackpot Wheel 6 |
| 280-286 | Jackpot Wheel 5 |
| 260-279 | Jackpot Wheel 4 |
| 240-259 | Jackpot Wheel 3 |
| 220-239 | Jackpot Wheel 2 |
| 200-219 | Jackpot Wheel 1 |
| 180-199 | 1,000 credits |
| 170-179 | 800 credits |
| 160-169 | 500 credits |
| 150-159 | 300 credits |
| 140-149 | 200 credits |
| 120-139 | 100 credits |

It should be noted that the table above provides a payout schedule which utilizes a combination of bonus credits (for lower number of wins) and jackpot bonus wheels (for higher number of wins). In accordance with one embodiment, each level of the jackpot wheel that is higher than the last includes a relatively larger number of higher value prizes and/or prizes of relatively higher values. In one example implementation, a GUI may output an indication that the player has qualifies for a prize to be determined via a jackpot wheel once the count of wins attributable to the side the player wagered on has been determine to reach at least the threshold level for the jackpot wheel (200 wins in the example payout schedule of the table above). For example, an image or other indicator of a jackpot wheel (or a particular level of the jackpot wheel, if more than one is available) may be lit up or otherwise activated or highlighted on the GUI. In embodiments in which a jackpot wheel is utilized to determine a bonus payout, process 500 (or an additional process or sub-routine) may be initiated once a player has qualified for the jackpot wheel bonus payout determination in order to determine the particular bonus payout to be awarded to the player.

In some embodiments, a bonus payout mechanic may not be utilized for a multi-payline baccarat game as described herein. For example, a simple payout determination may be employed in which the player is provided a payout based on a predetermined number of credits (e.g., two) per payline which has a win attributable to the side the player wagered on, without additional bonus payouts being implemented.

Once the appropriate total payout for the present game instance has been calculated, the payout may be provided to the player (e.g., as an additional step of process 500, not shown). For example, an appropriate number of credits may be added to a credit meter balance of the player. In some embodiments, process 500 may also comprise outputting a message to a player (e.g., via a GUI of the game) to inform the player of how much he has won as a result of the multi-payline baccarat wager and how this payout was derived.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Rules of Interpretation

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium or an article of manufacture, which may be non-transitory in nature). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory", "article of manufacture" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Radio Frequency Identification (RFID), Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a web site maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

What is claimed is:

1. An apparatus for facilitating an electronic baccarat game, the apparatus comprising:

a processor, a display device operable to output an electronic game interface, an input device, and a game controller comprising:

a processor, and a first non-transitory memory operable to communicate with the processor, the first memory storing a game program comprising instructions for directing the processor to manage the electronic baccarat game, wherein the processor is operable with the game program to:

output, on the display device, an electronic game interface comprising a plurality of element positions arranged in a matrix comprising a plurality of rows and a plurality of columns, the matrix available for placement of game elements and including a plurality of paylines, each payline consisting of a specified subset of the element positions and including a first plurality of element positions corresponding to a Player hand and a second plurality of element positions corresponding to a Banker hand;

arrange, for a game instance on which a player has placed a wager, game elements into at least a subset of the plurality of element positions;

determine which one of Player side and Banker side the player has selected when placing the wager, thereby determining the player's win prediction that defines whether the player is placing a wager that there will be more winning Player hands or more Banker winning hands for the game instance;

determine, for each payline of the plurality of paylines, which of the Player hand and the Banker hand is a winning hand for that payline;

determine a number of paylines of the plurality of paylines for which the Player hand is a winning hand, thereby determining a number of Player hand wins for the game instance;

determine a number of paylines of the plurality of paylines for which the Banker hand is the winning hand, thereby determining a number of Banker hand wins for the game instance;

determine a payout to provide to the player for the game instance based on (i) the player's win prediction and (ii) one of the number of the Player hand wins and the number of Banker hand wins.

2. The apparatus of claim 1, wherein a selection by the player of the Player side indicates that the player is predicting there will be more Player hand wins than Banker side wins as a result of the game instance and a selection by the player of the Banker side indicates that the player is predicting there will be more Banker hand wins than Player side wins as a result of the game instance.

3. The apparatus of claim 1, wherein the processor further stores in the non-transitory memory a plurality of symbol images for use in the electronic baccarat game, and wherein the processor being operable with the program to arrange, for a game instance on which a player has placed a wager, game elements into at least a subset of the plurality of element positions comprises the processor being operable with the game program to place symbol images from the plurality of symbol images into the element positions.

4. The apparatus of claim 1, wherein the input device comprises a wager initiation mechanism and wherein the processor is further operable with the program to detect when the player has actuated the wager initiation mechanism.

5. The apparatus of claim 1, wherein the processor is further operable with the game program to:

compare the number of Player hand wins and the number of Banker hand wins;

provide a payout to the player if (i) the number of Player hand wins is greater than the number of Banker hand wins and (ii) the player's win prediction comprises a selection of the Player side; and provide a payout to the player if (ii) the number of Banker hand wins is greater than the number of Player hand wins and (ii) the player's win prediction comprises a selection of the Banker side.

6. The apparatus of claim 1, wherein the processor is further operable with the game program to:

determine a value of the payout to be provided to the player by:

determining a payout schedule which defines a plurality of payout values, each value corresponding to a respective range of number of wins;

determine, based on the player's win prediction, one of the number of Player hand wins and the number of Banker hand wins to utilize for determining the value of the payout to be provided to the player, thereby determining the player's number of wins;

select one value of the plurality of payout values from the payout schedule by selecting the payout value which corresponds to a range of numbers within which the player's number of wins fits, thereby determining at least a portion of the value of the payout to be provided to the player.

7. The apparatus of claim 6, wherein the processor being operable with the game program to determine the value of the payout further comprises:

determining a wager amount.

8. The apparatus of claim 1, wherein the processor is further operable with the game program to:

identify the game elements to be arranged into the at least a subset of the element positions.

9. The apparatus of claim 8, wherein the processor is operable with the game program to identify the game elements to be arranged into the at least a subset of the element positions in accordance with an algorithm for determining a result of the game instance.

10. The apparatus of claim 8, wherein the processor is operable with the game program to identify the game elements to be arranged into the at least a subset of the element positions based on game elements which were dealt in a live baccarat game conducted at a table for facilitating the live baccarat game.

11. The apparatus of claim 1, wherein each payline comprises three element positions corresponding to the Player hand and three different element positions corresponding to the Banker hand such that each payline consists of at least six element positions.

12. The apparatus of claim 11, wherein the processor being operable with the game program to arrange, for a game instance on which a player has placed a wager, game elements into at least a subset of the plurality of element positions, comprises the processor being operable with the game program to:

arrange, for each payline, a game element into each of two of the three element positions corresponding to the Player hand of the payline; and arrange, for each payline, a game element into each of two of the three element positions corresponding to the Banker hand of the payline.

13. The apparatus of claim 12, wherein the processor is further operable with the game program to:

determine, based on the two cards arranged into element positions of a Player hand of a given payline, whether a third element is to be placed into a third element position of the payline.

14. The apparatus of claim 11, wherein the processor is further operable with the game program to:

determine, for a given payline and based on an algorithm, a preliminary set of game elements sufficient to populate only a subset of the at least six element positions of the payline, thereby leaving at least one remaining element position of the at least six element positions of the payline into which game elements of the preliminary set of game elements are not populated;

determine, for the payline and based on a second methodology different from the algorithm, at least one game element to be placed into the at least one remaining element position of the at least six element positions of the payline; and populate the at least six element positions with a combination of the game elements determined based on the algorithm and the at least one game element determined based on the second methodology.

15. The apparatus of claim 14, wherein the processor being operable with the game program to determine, for the payline and based on a second methodology different from the algorithm, at least one game element to be placed into the at least one remaining element position of the at least six element positions of the payline comprises the processor being operable with the program to:

receive from the player a selection of the at least one game element to be placed into the at least one remaining element position of the at least six element positions of the payline.

16. The apparatus of claim 15, wherein the processor is further operable with the game program to:

output to the player a game interface in which a plurality of player-selectable game elements are arranged, wherein the processor being operable with the program to receive a selection of at least one game element to be placed into the at least one remaining element position comprises the processor being operable with the program to receive the selection of at least one game element of the plurality player-selectable of game elements output in the game interface.

17. The apparatus of claim 16, wherein the plurality of player-selectable game elements are output in the game interface in a manner that does not allow the player to know a respective value of any of the plurality of player-selectable game elements prior to selection.

18. The apparatus of claim 14, wherein the processor being operable with the game program to determine, for each payline of the plurality of paylines, which of the Player hand and the Banker hand is a winning hand for that payline comprises the processor being operable with the program to:

determine, for each payline of the plurality of paylines and based on the combination of the game elements determined based on the algorithm and the at least one game element determined based on the second methodology, which of the Player hand and the Banker hand is a winning hand for that payline.

19. The apparatus of claim 14, wherein the processor being operable with the game program to determine, for each payline of the plurality of paylines, which of the Player hand and the Banker hand is a winning hand for that payline comprises the processor being operable with the program to:

determine, for each payline of the plurality of paylines and based on the game elements determined based on the algorithm but not on the at least one game element determined based on the second methodology, which of the Player hand and the Banker hand is a winning hand for that payline.

20. The apparatus of claim 14, wherein the processor is further operable with the game program to:

determine, for a given payline, a benefit defined by the at least one game element determined based on the second methodology; and apply, for the given payline, the benefit to the one of the Player hand and the Banker hand that is determined to be the winning hand for the payline.

21. The apparatus of claim 20, wherein the benefit is a multiplier value and the processor being operable with the game program to apply the benefit comprises the processor being operable with the program to multiply a payout the player wins as a result of the given payline by the multiplier.

22. The apparatus of claim 20, wherein the benefit is a third number and the processor being operable with the game program to apply the benefit comprises the processor being operable with the game program to add, prior to determining a value of a payout to provide to the player, the third number to one of (i) the number of Player hand wins and (ii) the number of Banker hand wins, such that the value of the payout is determined based on a sum of the third number and one of the number of Player hand wins and the number of Banker hand wins.

23. The apparatus of claim 1, wherein the processor is further operable with the game program to:

receive a side wager from the player for the game instance; and determine whether the player wins the side wager as a result of the game instance.

24. The apparatus of claim 23, wherein the side wager comprises a wager that one of the number of Player hand wins and the number of Banker hand wins will be within a specified range of numbers.

25. The apparatus of claim 23, wherein the side wager comprises a wager that at least one payline of the plurality of paylines will achieve a predetermined criteria.

26. The apparatus of claim 1, wherein the processor being operable with the game program to determine a payout to provide to the player for the game instance comprises the processor being operable with the game program to calculate a payout amount based on the number of hand wins attributable to the side on which the player wagered on.

27. The apparatus of claim 1, wherein the plurality of paylines comprises 239 paylines.

* * * * *